US007500733B2

(12) United States Patent
Takagi et al.

(10) Patent No.: US 7,500,733 B2
(45) Date of Patent: Mar. 10, 2009

(54) INK JET PRINTER

(75) Inventors: Osamu Takagi, Nagoya (JP); Susumu Kuzuya, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 580 days.

(21) Appl. No.: 11/150,433

(22) Filed: Jun. 13, 2005

(65) Prior Publication Data

US 2005/0275706 A1 Dec. 15, 2005

(30) Foreign Application Priority Data

Jun. 14, 2004 (JP) ..... 2004-175436

(51) Int. Cl.
*B41J 2/165* (2006.01)
*B41J 2/01* (2006.01)

(52) U.S. Cl. ..... 347/35; 347/22; 347/104

(58) Field of Classification Search ..... 347/22, 347/23, 29, 32, 35, 36, 104, 101
See application file for complete search history.

(56) References Cited

U.S. PATENT DOCUMENTS 5,534,897 A * 7/1996 Anderson et al. ..... 347/32
5,943,081 A * 8/1999 Uchida et al. ..... 347/104
6,550,887 B2 * 4/2003 Therien et al. ..... 347/22
6,916,081 B2 * 7/2005 Nakashima ..... 347/32
7,128,389 B2 * 10/2006 Okamoto et al. ..... 347/29
7,354,134 B2 * 4/2008 Okamoto ..... 347/33
2002/0044168 A1 * 4/2002 Hashi et al. ..... 347/32

FOREIGN PATENT DOCUMENTS

| | | |
|---|---|---|
| EP | 0 521 691 | 1/1991 |
| EP | 1 504 904 | 2/2005 |
| JP | 2000-168062 | 6/2000 |
| JP | 2000-211159 | 8/2000 |
| JP | 2003-063033 | 3/2003 |
| JP | 2000-103086 | 4/2005 |

* cited by examiner

*Primary Examiner*—Stephen D Meier
*Assistant Examiner*—Leonard S Liang
(74) *Attorney, Agent, or Firm*—Banner & Witcoff, Ltd.

(57) ABSTRACT

In order to make maintenance of an ink jet printer less time-consuming, when ink is to be purged from ink jet heads 1, a unit conveying mechanism 30 moves a feeding plane 11*a* of a feeding sheet 11 to a retreated position that is inclined with respect to ink jet faces 4*a* of the ink jet heads 1. An ink receiving sheet 21 is then moved to an ink receiving position that is between the ink jet faces 4*a* and the feeding plane 11*a* and that extends along this feeding plane 11*a*. Ink that is jetted onto the ink receiving sheet 21 from the ink jet faces 4*a* of the ink jet heads 1 runs down the ink receiving sheet 21, and is collected in an ink tank 72.

18 Claims, 20 Drawing Sheets

INK JET PRINTER

CROSS-REFERENCE TO RELATED APPLICATION

This application claims priority to Japanese Patent Application No. 2004-175436, filed on Jun. 14, 2004, the contents of which are hereby incorporated by reference into the present application.

BACKGROUND OF THE INVENTION

1. Field of the Invention

The present invention relates to an ink jet printer for printing on a printing sheet by jetting ink.

2. Description of the Related Art

An ink jet printer is provided with an ink jet head. Ink is jetted from the ink jet head. The ink jet head is provided with an ink jet nozzle, a pressure chamber joined with the ink jet nozzle, and an actuator disposed in a position adjacent to the pressure chamber. Capacity of the pressure chamber is reduced when the actuator is driven, and a quantity of ink corresponding to this reduction in capacity is jetted from the ink jet nozzle. The ink jet nozzle, the pressure chamber, and the actuator form a set, and normal ink jet heads are provided with a plurality of these sets.

Extremely viscous ink may adhere to the interior of the ink jet nozzles of the ink jet head. Alternatively, impurities or bubbles that have flowed from an ink tank may be present in the ink jet head. When these occur, the jetting characteristics of the ink are disturbed, and satisfactory printing quality cannot be obtained. A purge process must therefore be executed periodically. Ink is jetted from all the ink jet nozzles during the purge process, and the extremely viscous ink, the impurities, or the bubbles that are present in the ink jet head are thus discharged.

A technique is known wherein, in order to collect ink that was jetted during a purge process, an ink receiving sheet is disposed between an ink jet head and a conveying mechanism for conveying the printing sheet. This technique is taught in Japanese Laid Open Patent Publication 2000-211159, Japanese Laid Open Patent Publication 2003-63033, and Japanese Laid Open Patent Publication 2000-168062.

In these techniques, the ink receiving sheet is capable of moving. During normal usage of the printer, i.e. during normal printing operations, the ink receiving sheet is caused to retreat to a position that is not opposite the ink jet head. When the purge process is performed, the ink receiving sheet is conveyed to a position opposite the ink jet head.

In the techniques taught in Japanese Laid Open Patent Publication 2003-63033 and Japanese Laid Open Patent Publication 2000-168062, the ink receiving sheet is formed from a material that absorbs ink. Consequently, the ink that was jetted during the purge process does not run down from the ink receiving sheet.

In the technique taught in Japanese Laid Open Patent Publication 2000-211159, the ink receiving sheet is provided with a separate ink collecting body. The ink caught by the ink receiving sheet is absorbed by the ink collecting body, and consequently the ink that was jetted during the purge process does not run down from the ink receiving sheet.

Ink absorbing capability is limited in all these techniques, and the component that absorbs the ink must be exchanged frequently. In the techniques of Japanese Laid Open Patent Publication 2003-63033, and Japanese Laid Open Patent Publication 2000-168062, the ink receiving sheet that absorbs the ink must be exchanged frequently. In the technique of Japanese Laid Open Patent Publication 2000-211159, the ink collecting body must be exchanged frequently.

Since exchanging the ink receiving sheet or the ink collecting body is a complex operation, maintenance of the ink jet printer is extremely time-consuming.

BRIEF SUMMARY OF THE INVENTION

An object of the present invention is to present an ink jet printer wherein ink that was jetted onto an ink receiving sheet during a purge process can be discarded easily.

An ink jet printer of the present invention includes an ink jet head, a unit, a unit moving mechanism, and an ink collecting mechanism.

The ink jet head includes an ink jet face and a plurality of ink jet nozzles distributed on the ink jet face. The unit includes a first conveying mechanism that conveys the printing sheet along a feeding plane, an ink receiving sheet that receives ink jetted from the ink jet head, and a second conveying mechanism that conveys the ink receiving sheet between a first position and a second position. The ink receiving sheet is not opposite the ink jet face when the ink receiving sheet is at the first position. The ink receiving sheet is opposite the ink jet face when the ink receiving sheet is at the second position. The unit moving mechanism moves the unit between a third position and a fourth position. The feeding plane of the unit is parallel to the ink jet face when the unit is at the third position. The feeding plane of the unit is inclined with respect to the ink jet face when the unit is at the fourth position. The ink collecting mechanism collects ink running down from the ink receiving sheet when the unit is at the fourth position and the ink receiving sheet is at the second position.

When the ink receiving sheet has been conveyed to the second position and the unit has been moved to the fourth position in the aforementioned ink jet printer, the ink receiving sheet is opposite the ink jet face, and the ink receiving sheet is inclined from a horizontal position.

As a result, the self-weight of the ink jetted onto the ink receiving sheet during a purge process allows this ink to flow rapidly down the ink receiving sheet, and the ink can easily be collected in the ink collecting mechanism.

In this ink jet printer, only the ink stored in the ink collecting mechanism needs to be discarded. The complex operation of exchanging the ink receiving sheet or the ink collecting body, as in the conventional case, is not required. The ink can be discarded easily.

DETAILED DESCRIPTION OF THE INVENTION

Figure 1:
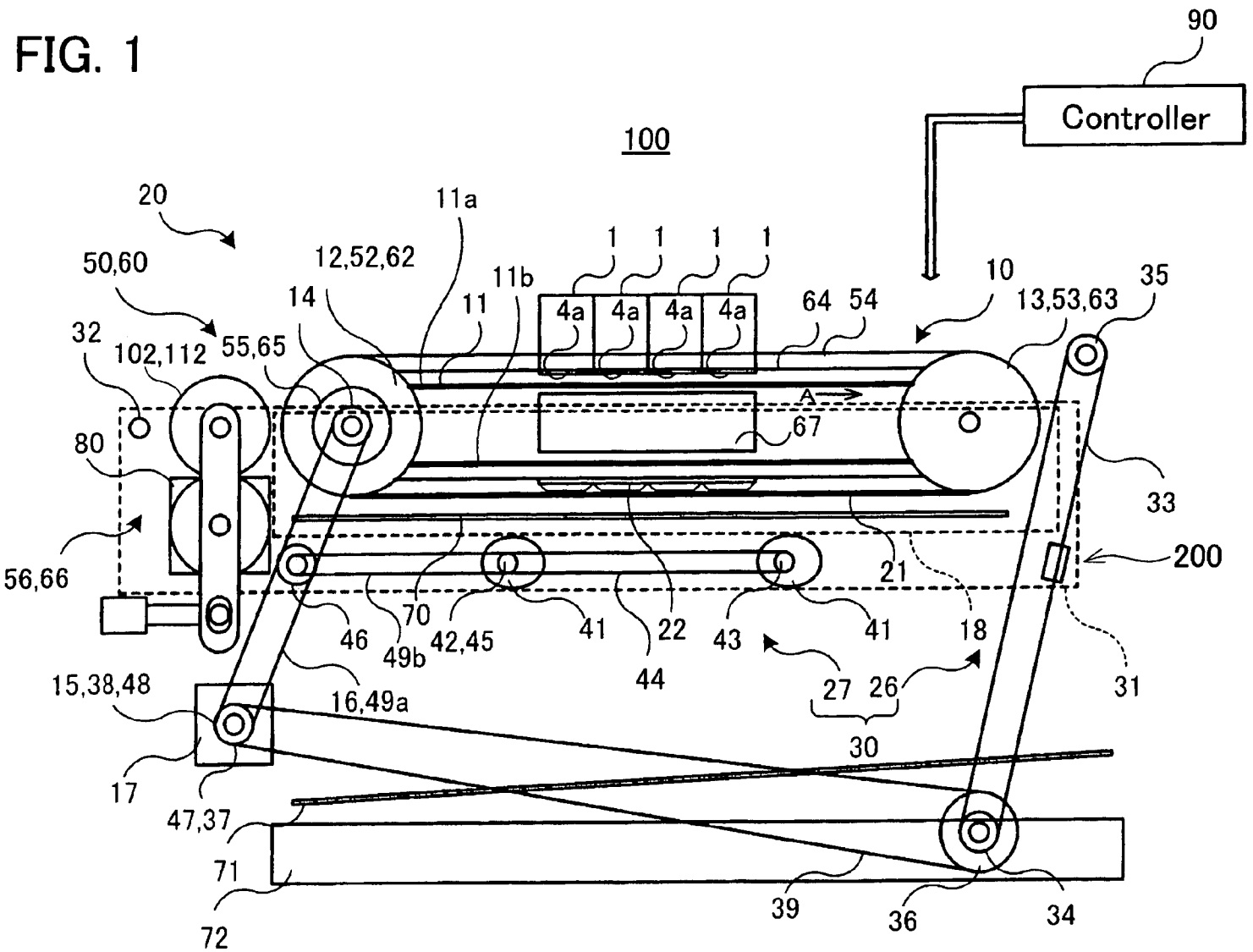
FIG. 1 shows a schematic diagram of an ink jet printer of a representative embodiment of the present teachings.

A preferred representative embodiment of the present teachings will be described below with reference to the drawings. FIG. 1 shows a schematic diagram of an ink jet printer of a representative embodiment of the present teachings. FIG. 1 shows the ink jet printer engaged in a printing operation.

The ink jet printer 100 forms a desired image on a printing sheet by jetting ink droplets onto the printing sheet, and includes four ink jet heads 1 for jetting the ink droplets, a feeding sheet 11 for supporting the printing sheet, a feeding sheet conveying mechanism 10, a maintenance mechanism 20 for performing maintenance of the ink jet printer 100, and a controller 90 for controlling operations of the ink jet printer 100.

The feeding sheet 11 and the feeding sheet conveying mechanism 10 are mounted in a unit 200. The unit 200 includes a swing frame 31 and a lift frame 18. The feeding sheet 11 and the feeding sheet conveying mechanism 10 are supported by the lift frame 18.

Figure 18:
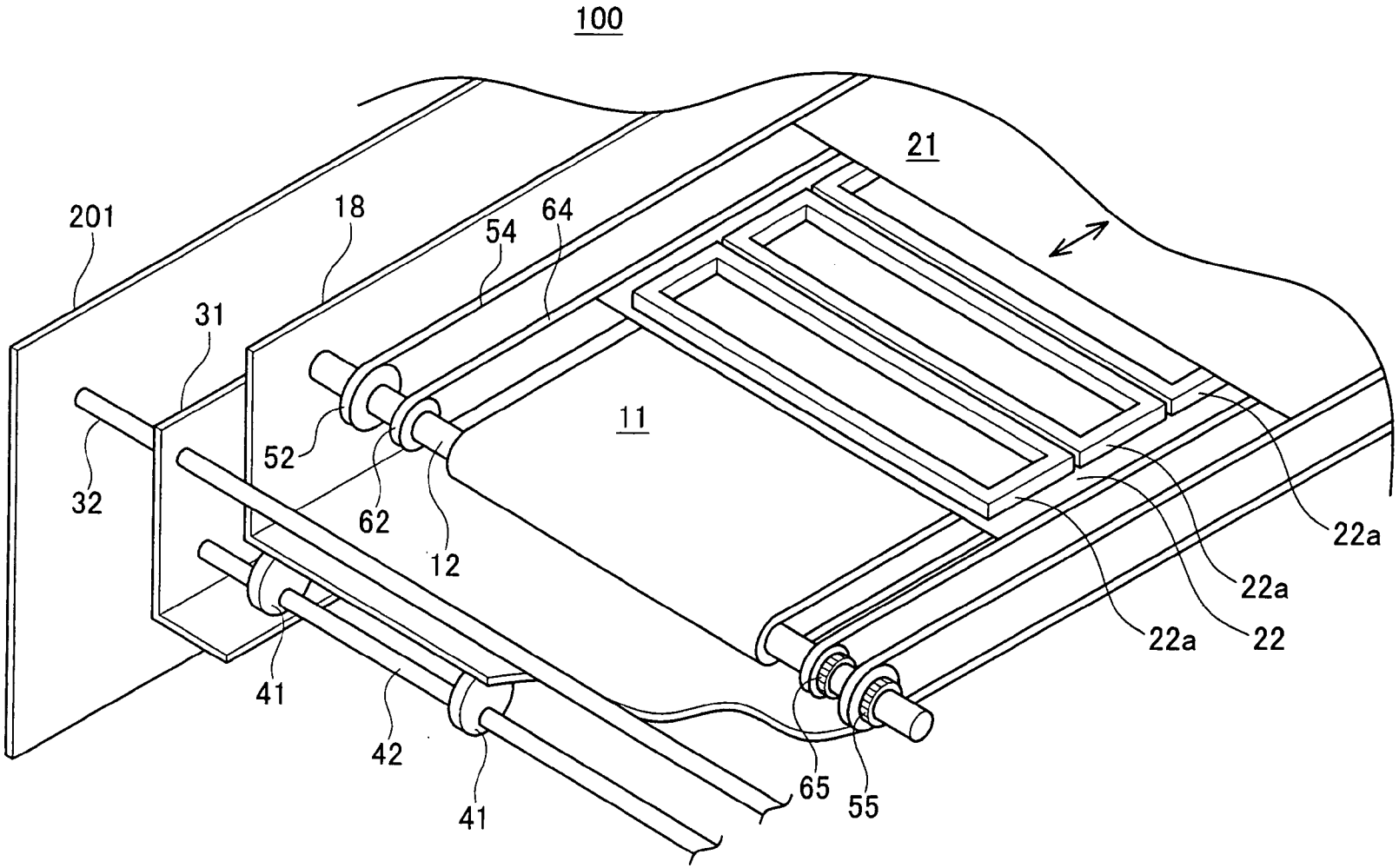
FIG. 18 shows a diagonal view schematically showing essential parts of the ink jet printer of the representative embodiment.

FIG. 18 shows essential parts of the ink jet printer 100, and shows how the swing frame 31 can swing with respect to a main body frame 201 by means of a swing axis (a pivot axis) 32. The lift frame 18 can be raised and lowered with respect to the swing frame 31 by means of an eccentric cam 41.

A pair of feeding sheet conveying rollers 12 and 13 (the feeding sheet conveying roller 13 is not shown in FIG. 18, but is shown in FIG. 1) are supported by the lift frame 18 in a manner allowing rotation with respect to this lift frame 18. The feeding sheet 11 includes an endless belt (carrier) that is wound between the feeding sheet conveying rollers 12 and 13. The feeding sheet conveying mechanism 10 includes the pair of feeding sheet conveying rollers 12 and 13, etc.

Ink receiving sheet conveying rollers 52 and 53 (the ink receiving sheet conveying roller 53 is not shown in FIG. 18, but is shown in FIG. 1) are supported by the lift frame 18 in a manner allowing rotation with respect to the lift frame 18. The ink receiving sheet conveying roller 52 is coaxial with the feeding sheet conveying roller 12. The ink receiving sheet conveying roller 53 is coaxial with the feeding sheet conveying roller 13. An ink receiving sheet conveying belt (a second belt) 54 is wound between the pair of ink receiving sheet conveying rollers 52 and 53. An ink receiving sheet 21 is fixed to the ink receiving sheet conveying belt 54. The pair of ink receiving sheet conveying rollers 52 and 53, the ink receiving sheet conveying belt 54, etc. form an ink receiving sheet conveying mechanism 50.

Capping sheet conveying rollers 62 and 63 (the capping sheet conveying roller 63 is not shown in FIG. 18, but is shown in FIG. 1) are supported by the lift frame 18 in a manner allowing rotation with respect to the lift frame 18. The capping sheet conveying roller 62 is coaxial with the feeding sheet conveying roller 12. The capping sheet conveying roller 63 is coaxial with the feeding sheet conveying roller 13. A capping sheet conveying belt (a third belt) 64 is wound between the pair of capping sheet conveying rollers 62 and 63. A capping sheet 22 is fixed to the capping sheet conveying belt 64. The pair of capping sheet conveying rollers 62 and 63, the capping sheet conveying belt 64, etc. forms a capping sheet conveying mechanism 60. The four ink jet heads 1 (not shown in FIG. 8. See FIG. 1) are fixed to the main body frame 201.

The diameter of the ink receiving sheet conveying rollers 52 and 53 is greater than the diameter of the capping sheet conveying rollers 62 and 63. The diameter of the capping sheet conveying rollers 62 and 63 is greater than the diameter of the feeding sheet conveying roller 12 and 13. As a result, the capping sheet 22 is conveyed along the outer side of the endless belt that includes the feeding sheet 11, and the ink receiving sheet 21 is conveyed along a side yet further outwards.

Figure 19:
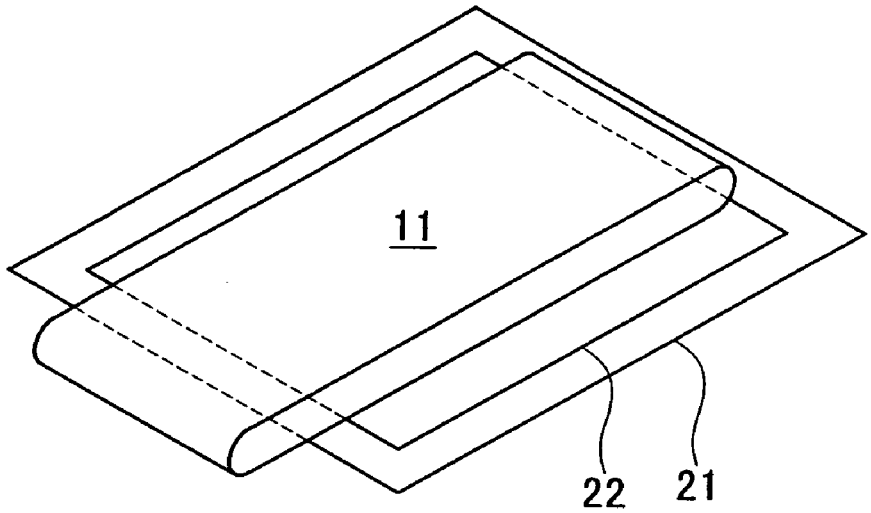
FIG. 19 shows a feeding sheet, an ink receiving sheet, and a capping sheet, and shows a state where the ink receiving sheet is at a first position and the capping sheet is at a sixth position.

FIG. 19 shows a state where the capping sheet 22 and the ink receiving sheet 21 are located below the endless belt that forms the feeding sheet 11. In this state, the ink jet heads 1 are directly opposite the feeding sheet 11. The printing sheet supported and conveyed by the feeding sheet 11 can be printed by the ink jet heads 1.

Figure 20:
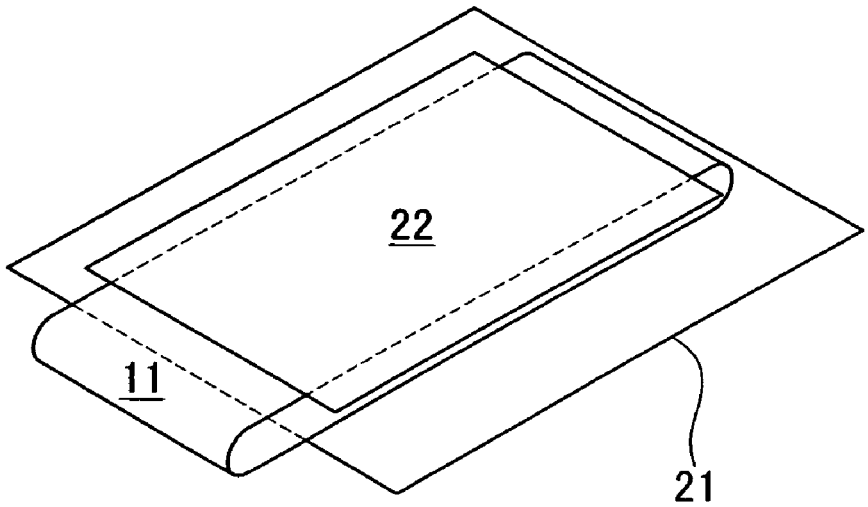
FIG. 20 shows the feeding sheet, the ink receiving sheet, and the capping sheet, and shows a state where the ink receiving sheet is at the first position and the capping sheet is at a fifth position.

FIG. 20 shows a state where the capping sheet 22 is located above the endless belt 11, and where the ink receiving sheet 21 is located below the endless belt 11. In this state, the capping sheet 22 fits tightly with ink jet faces of the ink jet heads 1 when the lift frame 18 is raised. The ink jet nozzles are thus sealed from the air.

Figure 21:
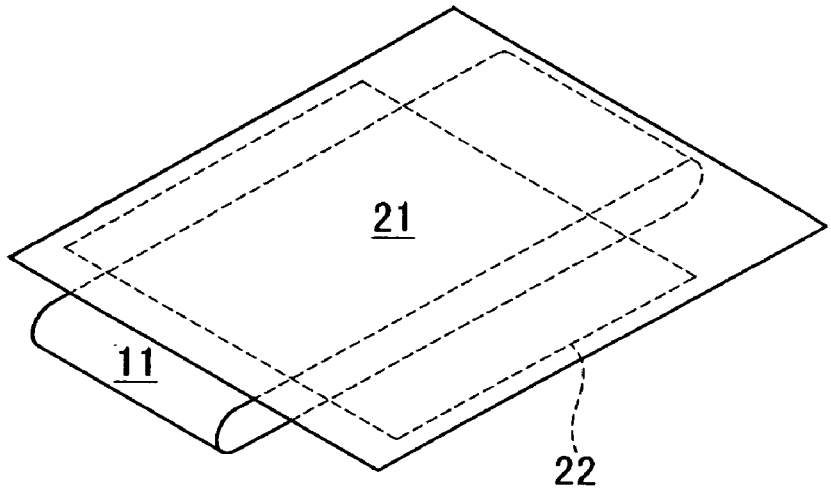
FIG. 21 shows the feeding sheet, the ink receiving sheet, and the capping sheet, and shows a state where the ink receiving sheet is at a second position and the capping sheet is at the fifth position.
Figure 22:
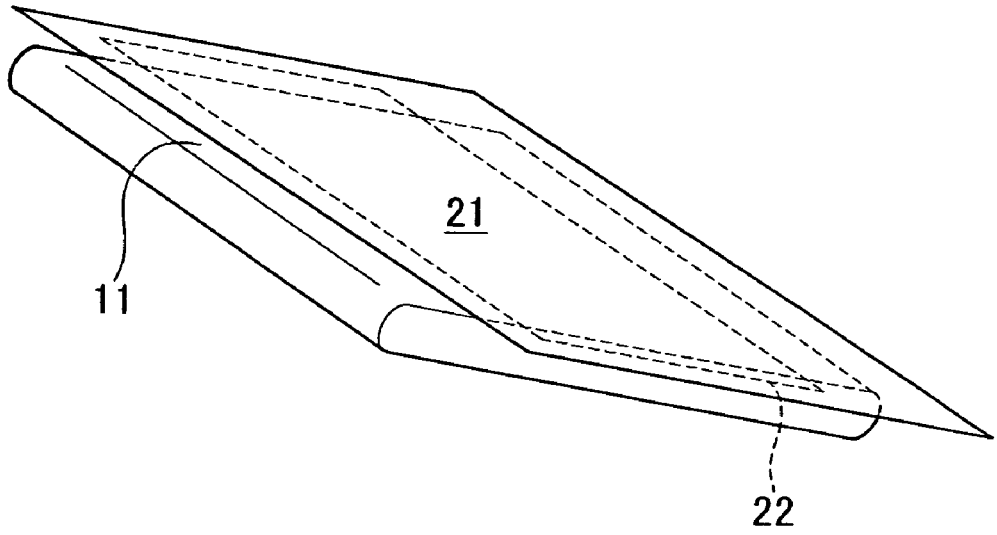
FIG. 22 shows the feeding sheet, the ink receiving sheet, and the capping sheet, and shows a state where a unit is at a fourth position, the ink receiving sheet is at the second position, and the capping sheet is at the fifth position.

FIG. 21 shows a state where the ink receiving sheet 21 and the capping sheet 22 are located above the endless belt 11. In this state, when the unit 200 is swung as shown in FIG. 22, the ink receiving sheet 21 is located in an uppermost position and is directly opposite the ink jet heads 1. The ink receiving sheet 21 receives ink jetted by the ink jet heads 1. The ink receiving sheet 21 is inclined with respect to a horizontal line, and the self-weight of the ink received by the ink receiving sheet 21 causes this ink to flow down the ink receiving sheet 21. The ink that has flowed down from the ink receiving sheet 21 is collected in an ink collecting tank 72 (to be described).

The maintenance mechanism 20 can be moved between the position in FIG. 19 and the position in FIG. 22, and is provided to perform maintenance of the ink jet heads 1.

The positional relationship of FIG. 19 is realized during normal printing operations. When the ink jet printer 100 is not used for a long time, the positional relationship of FIG. 20 is realized so as to protect the ink jet nozzles from the air and to thus prevent the ink within the ink jet nozzles from drying out. If a purge process is to be executed, the positional relationship of FIG. 22 is realized, ink that was jetted from the ink jet heads 1 during the purge process is received by the ink receiving sheet 21, and guided to an ink collecting tank 72 shown in FIG. 1.

The maintenance mechanism 20 includes the unit 200, a unit moving mechanism 30, a sheet cover 70 (see FIG. 1), an ink tray 71, and the ink collecting tank 72. As described above, the unit 200 includes the ink receiving sheet 21, the ink receiving sheet conveying mechanism 50, the capping sheet 22, and the capping sheet conveying mechanism 60. These are included in the maintenance mechanism 20. The unit 200 is provided with a maintenance motor 80. As will be described later, the maintenance motor 80 drives the ink receiving sheet conveying mechanism 50 and the capping sheet conveying mechanism 60 based on commands from the controller 90.

Figure 2:
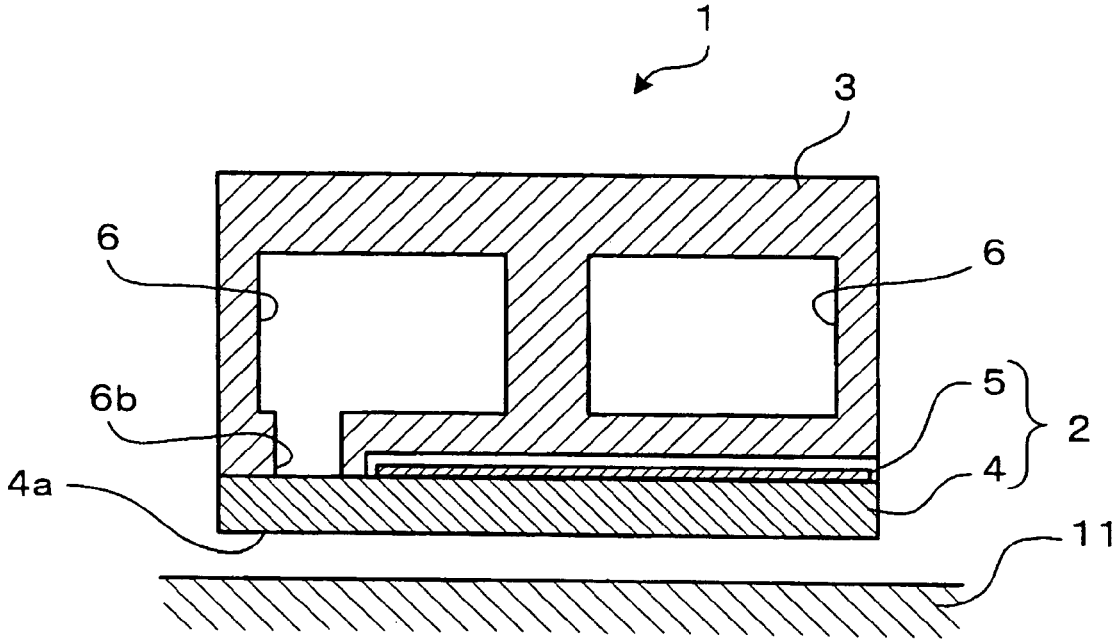
FIG. 2 shows a cross-sectional view along a widthwise direction of ink jet head shown in FIG. 1.
Figure 3:
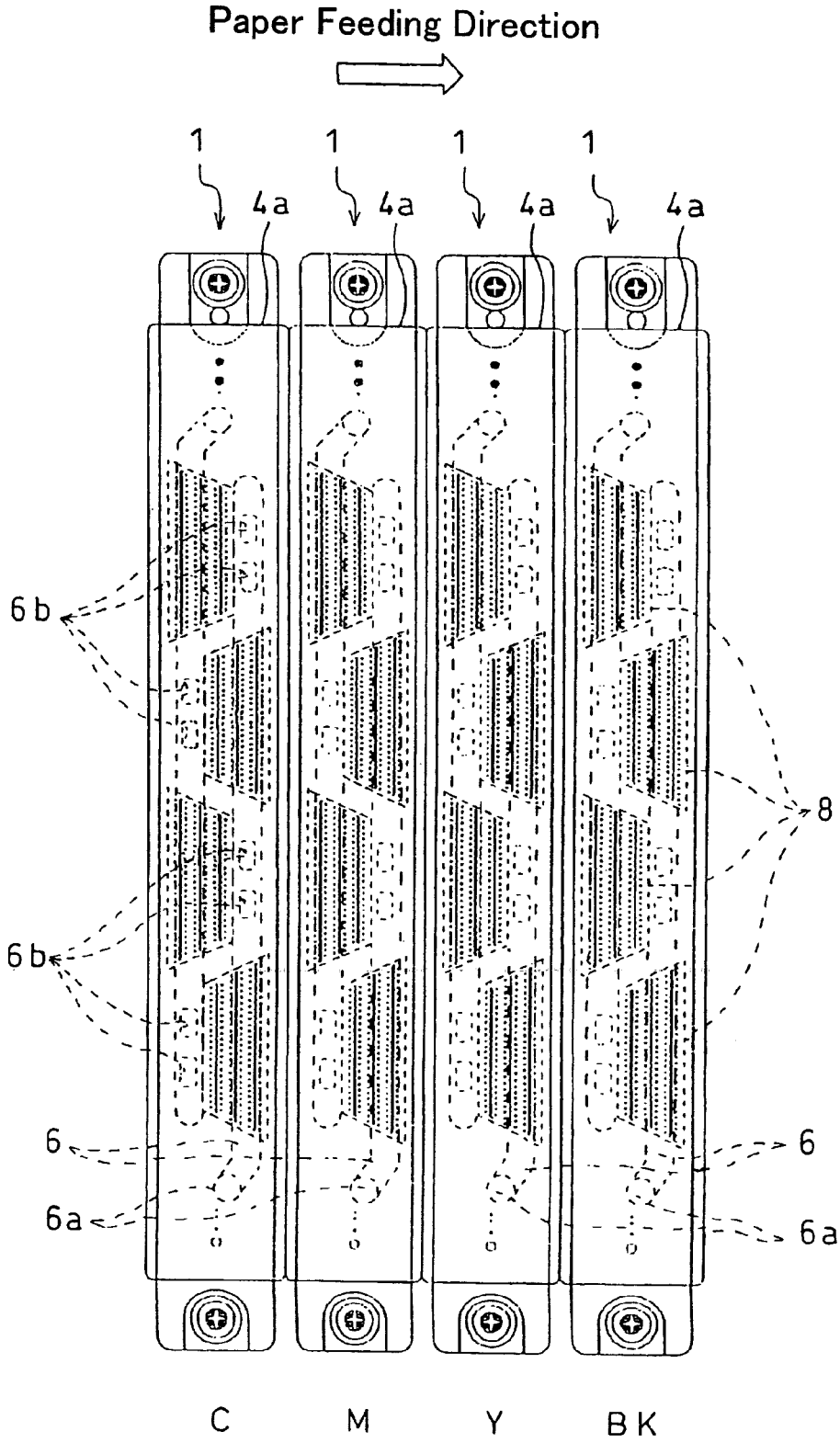
FIG. 3 shows ink jet faces of the ink jet heads shown in FIG. 1.

Four ink jet heads 1 are used in the ink jet printer 100. Four ink jet heads 1 are disposed to be mutually adjacent in the paper feeding direction, and jet one of the following inks: cyan, yellow, magenta, or black. The ink jet heads 1 will be described with reference to FIGS. 2 and 3. FIG. 2 shows a cross-sectional view along a widthwise direction of the ink jet head 1. FIG. 3 shows four ink jet faces 4*a* of the four ink jet heads 1. The ink jet heads 1 are controlled by the controller 90 to jet ink droplets. A lengthwise direction of each of the ink jet faces 4*a* is orthogonal to a paper feeding direction. The ink jet heads 1 are a line type that extend in the widthwise direction of the printing sheet. The length of the line type ink jet head is equal to or longer than the width of the printing sheet to be fed.

As shown in FIGS. 2 and 3, each ink jet head 1 is provided with a rectangular parallel-piped shaped block 3 and a rectangular parallel-piped shaped head main body 2. Two ink supply passages 6 are formed within the block 3. These ink supply passages 6 extend in the lengthwise direction of the block 3 and are mutually aligned in the widthwise direction of the block 3. The ink supply passages 6 each have an ink inflow passage 6*a* and an ink outflow passage 6*b*. The ink inflow passages 6*a* allow ink to flow inwards from an opening at a side opposite the side connected with the head main body 2. The ink within the ink supply passages 6 can flow into the head main body 2 from the ink outflow passages 6*b*.

The head main body 2 has a layered structure having a passage unit 4 and an actuator unit 5 stacked therein. The passage unit 4 is provided with an ink jet face 4*a* on which a plurality of ink jet nozzles 8 are distributed. The ink jet nozzles 8 have not been shown in FIG. 2. The ink jet face 4*a* is disposed so as to be horizontal.

Ink passages are formed within the passage unit 4. These ink passages include the ink jet nozzles 8 and pressure chambers for jetting ink from the ink jet nozzles 8. A plurality of ink passages is formed. The actuator unit 5 is provided with a plurality of actuators for reducing capacity of the pressure chambers of the passage unit 4. The actuator unit 5 is disposed within a space between the block 3 and the passage unit 4, and each actuator is opposite one of the pressure chambers. The actuator unit 5 is driven by the controller 90 via a driver IC (not shown). When the controller 90 drives the actuators, the capacity is reduced of each pressure chamber that corresponds to one actuator, and a quantity of ink corresponding to this reduction in capacity is jetted from the ink jet nozzles 8.

As shown in FIG. 1, the endless belt-type feeding sheet 11 is conveyed in the direction shown by the arrow A. The feeding sheet 11 conveys the printing sheet from the left side in the figure (below, this will be termed a supply side) along a feeding plane (an upper face of the endless belt-type feeding sheet 11) to a right side in the figure (below, this will be termed a paper discharge side).

The feeding sheet conveying mechanism 10 includes a feeding motor 17, an output pulley 15, a transfer belt 16, a driving pulley 14, and the pair of feeding sheet conveying rollers 12 and 13 (first rollers) that move the feeding sheet 11.

The feeding sheet conveying rollers 12 and 13 are supported by the lift frame 18 in a manner allowing their rotation with respect to the lift frame 18, and are maintained so as to be mutually parallel. The feeding sheet 11 is an endless belt, and is wound between the pair of feeding sheet conveying rollers 12 and 13. The feeding sheet 11 extends along a flat plane between the pair of feeding sheet conveying rollers 12 and 13. An upper side of the flat plane will be referred to below as a feeding plane, and a lower side of the flat plane will be referred to below as a returning plane. Silicone processing has been performed on an outer side plane (the feeding plane) of the endless belt feeding sheet 11 so as to provide adhesive force which maintains the printing sheet on the feeding plane of the feeding sheet 11. The printing sheet is conveyed from the supply side to the paper discharge side by rotating the feeding sheet conveying roller 12.

The feeding motor 17 operates based on a command from the controller 90. The output pulley 15 outputs the rotational force of the feeding motor 17, and is supported coaxially with an output axis of the feeding motor 17. The transfer belt 16 is wound across the output pulley 15 and the driving pulley 14, and transfers the rotational force output by the output pulley 15 to the driving pulley 14. The driving pulley 14 drives the feeding sheet conveying roller 12, and is fixed so as to be coaxial with the feeding sheet conveying roller 12.

The lift frame 18 supports the feeding sheet conveying rollers 12 and 13, and extends in the paper feeding direction. The lift frame 18 can be moved with respect to the swing frame 31 in a direction orthogonal to a feeding plane 11*a* of the feeding sheet conveying mechanism 10 (i.e. in an up-down direction). The feeding sheet conveying rollers 12 and 13 are supported, in a manner allowing their rotation, in side walls of both widthwise ends of the lift frame 18.

Next, the maintenance mechanism 20 will be described. The maintenance mechanism 20 is provided with the unit 200, the unit moving mechanism 30, the sheet cover 70, the ink tray 71, and the ink collecting tank 72. The unit 200 includes the ink receiving sheet 21, the ink receiving sheet conveying mechanism 50, the capping sheet 22, and the capping sheet conveying mechanism 60. These are also included in the maintenance mechanism 20. The unit 200 is provided with the maintenance motor 80. As will be described later, the maintenance motor 80 drives the ink receiving sheet conveying mechanism 50 and the capping sheet conveying mechanism 60 based on a command from the controller 90.

As will be described later, the sheet cover 70, the ink tray 71, and the ink collecting tank 72 collect the ink jetted onto the ink receiving sheet 21, and constitute an ink collecting mechanism.

Figure 4:
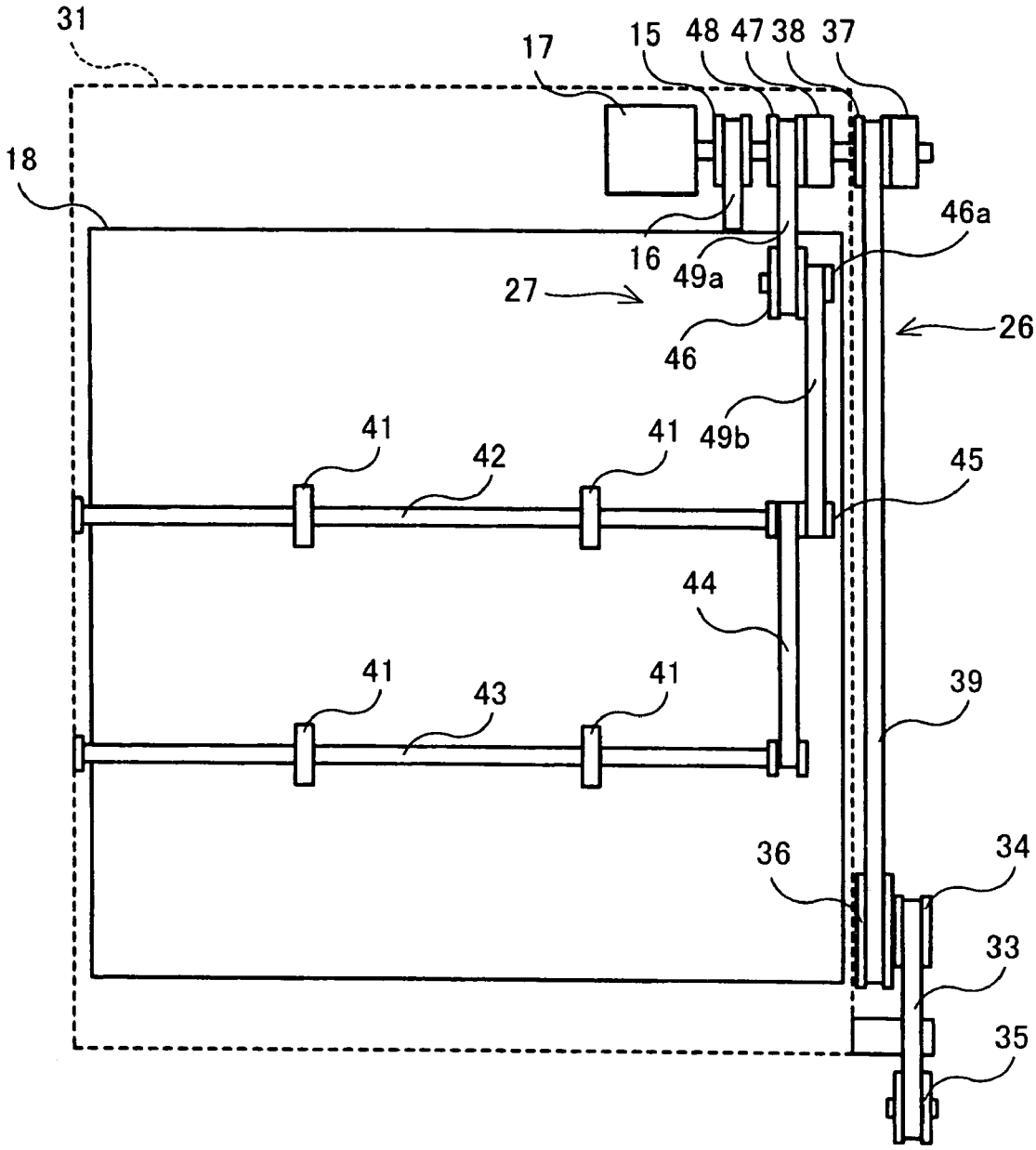
FIG. 4 shows a feeding sheet conveying mechanism and a unit moving mechanism viewed from a bottom face of the printer.

The unit moving mechanism 30 will now be described with reference to FIG. 4. FIG. 4 shows the feeding sheet conveying mechanism 10 and the unit moving mechanism 30, viewed from a bottom face of the ink jet printer 100. As shown in FIG. 1 and FIG. 4, the unit moving mechanism 30 moves the feeding sheet conveying mechanism 10 via the unit 200. The unit moving mechanism 30 is provided with a swing mechanism 26 and a lift mechanism 27. The swing mechanism 26 uses the rotational force of the feeding motor 17 to swing the unit 200 around the axis 32 and thus swing the unit 200 with respect to the main body frame 201. The swing mechanism 26 includes the feeding motor 17, a swing clutch 37, an output pulley 38, a transfer belt 39, a driving pulley 36, a driving roller 34, a swing belt 33, and a driving roller 35.

The swing frame 31 supports the following via the lift frame 18: the feeding sheet conveying mechanism 10, the ink receiving sheet conveying mechanism 50, and the capping sheet conveying mechanism 60. The swing frame 31 is capable of swinging with respect to the main body frame 201 (see FIG. 18) with the swing axis (the pivot axis) 32 as a center. The swing axis 32 is disposed at the supply side of the swing frame 31.

The output pulley 38 outputs the rotational force of the feeding motor 17. The swing clutch 37 joins or separates the output pulley 38 and the output axis of the feeding motor 17 based on a command from the controller 90. When the swing clutch 37 has joined the output axis of the feeding motor 17 and the output pulley 38, the feeding motor 17 causes the output pulley 38 to rotate, and the driving pulley 36 is rotated via the transfer belt 39. When the driving pulley 36 rotates, the driving roller 34 rotates, and the swing belt 33 is conveyed. The swing belt 33 is wound across the driving rollers 34 and 35. One location of the swing belt 33 is fixed to a paper discharge side end (an end part on the right side in FIG. 1) of the swing frame 31. The output pulley 38, the driving pulley 36, the driving roller 34, and the driving pulley 35 are supported by the main body 201. Thereupon, the paper discharge side end (the end part on the right side in FIG. 1) of the swing frame 31, to which the swing belt 33 is fixed at one location, is raised or lowered with respect to the main body 201. When this occurs, the swing frame 31 swings with respect to the main body 201 around the axis 32.

Figure 5:
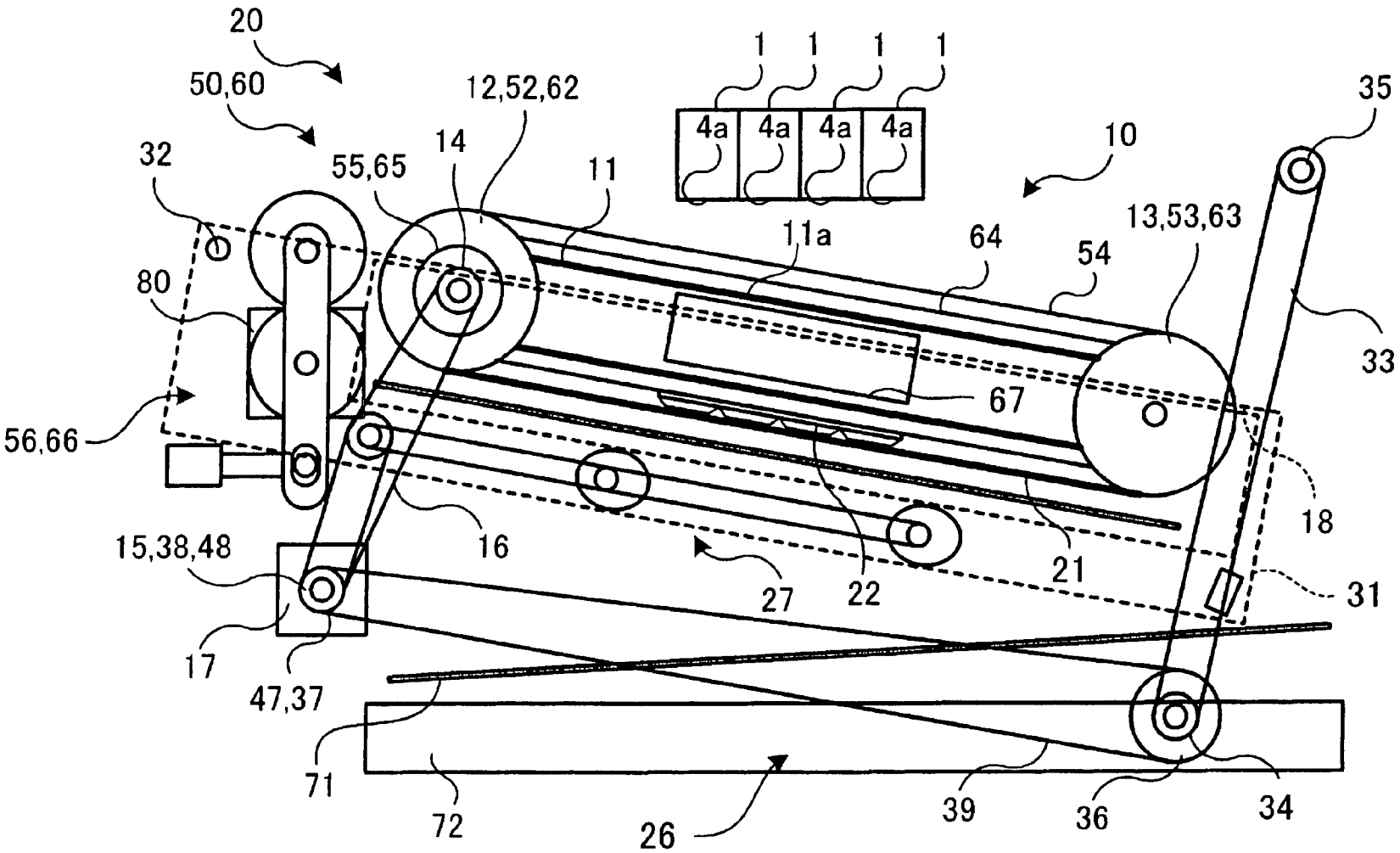
FIG. 5 shows an operating state of a swing mechanism (unit moving mechanism) shown in FIG. 1.

The operation of the swing mechanism 26 will now be described further with reference to FIG. 5. FIG. 5 shows an operating state of the swing mechanism 26. As shown in FIG. 5, when the swing clutch 37 is driven based on a command from the controller 90, the rotational force of the feeding motor 17 is output to the output pulley 38. Thereupon, the driving roller 34 is driven via the transfer belt 39 and the driving pulley 36. When the driving roller 34 is driven, the swing belt 33 is driven, and the right end of the swing frame 31 fixed to the swing belt 33 is raised or lowered. As a result, the swing frame 31 swings with the swing axis 32 as the center.

The feeding sheet conveying mechanism 10, the ink receiving sheet conveying mechanism 50, and the capping sheet conveying mechanism 60, all of which are supported by the swing frame 31 via the lift frame 18, are thus swung between a position where the feeding plane 11*a* of the endless belt-type feeding sheet 11 is parallel to the ink jet face 4*a* (this position is termed a third position. See FIG. 1), and a position where the feeding plane 11*a* of the endless belt-type feeding sheet 11 is at a retreated position that is inclined downwards, with respect to the ink jet face 4*a*, at the paper discharge side (this position is termed a fourth position. See FIG. 5). During normal printing operations, the feeding sheet conveying mechanism 10 is disposed at the third position shown in FIG. 1.

As shown in FIG. 1 and FIG. 4, the lift mechanism 27 raises and lowers the lift frame 18 with respect to the swing frame 31. That is, the lift mechanism 27 changes the position of the feeding sheet conveying mechanism 10, the ink receiving sheet conveying mechanism 50, and the capping sheet conveying mechanism 60 which are assembled in the lift frame 18, in a direction orthogonal to the feeding plane 11*a* (i.e. in an up-down direction).

The lift mechanism 27 includes the feeding motor 17, a lift clutch 47, an output pulley 48, a transfer belt 49*a*, pulleys 46 and 46*a*, a transfer belt 49*b*, a cam driving roller 45, a cam shaft 42, a cam joining belt 44, and a cam shaft 43.

The lift clutch 47 joins or separates the output pulley 48 and the output axis of the feeding motor 17 based on a command from the controller 90. The output pulley 48 outputs the rotational force of the feeding motor 17. The transfer belt 49*a* transfers the rotational force output by the output pulley 48 to the pulley 46. When the pulley 46 rotates, the pulley 46*a* also rotates. The transfer belt 49*b* transfers the rotational force output by the pulley 46*a* to the cam driving roller 45. When the cam driving roller 45 rotates, the cam shaft 42 rotates. The cam joining belt 44 synchronizes the cam shafts 42 and 43, and therefore when the cam shaft 42 rotates, the cam shaft 43 also rotates.

Four eccentric cams 41 have an elliptical shape and are located between the swing frame 31 and the lift frame 18. The eccentric cams 41 are disposed such that their centers all face the same direction. When the cam shafts 42 and 43 rotate, distance changes between the swing frame 31 and the lift frame 18. This structure is illustrated in FIG. 18, too.

Figure 6:
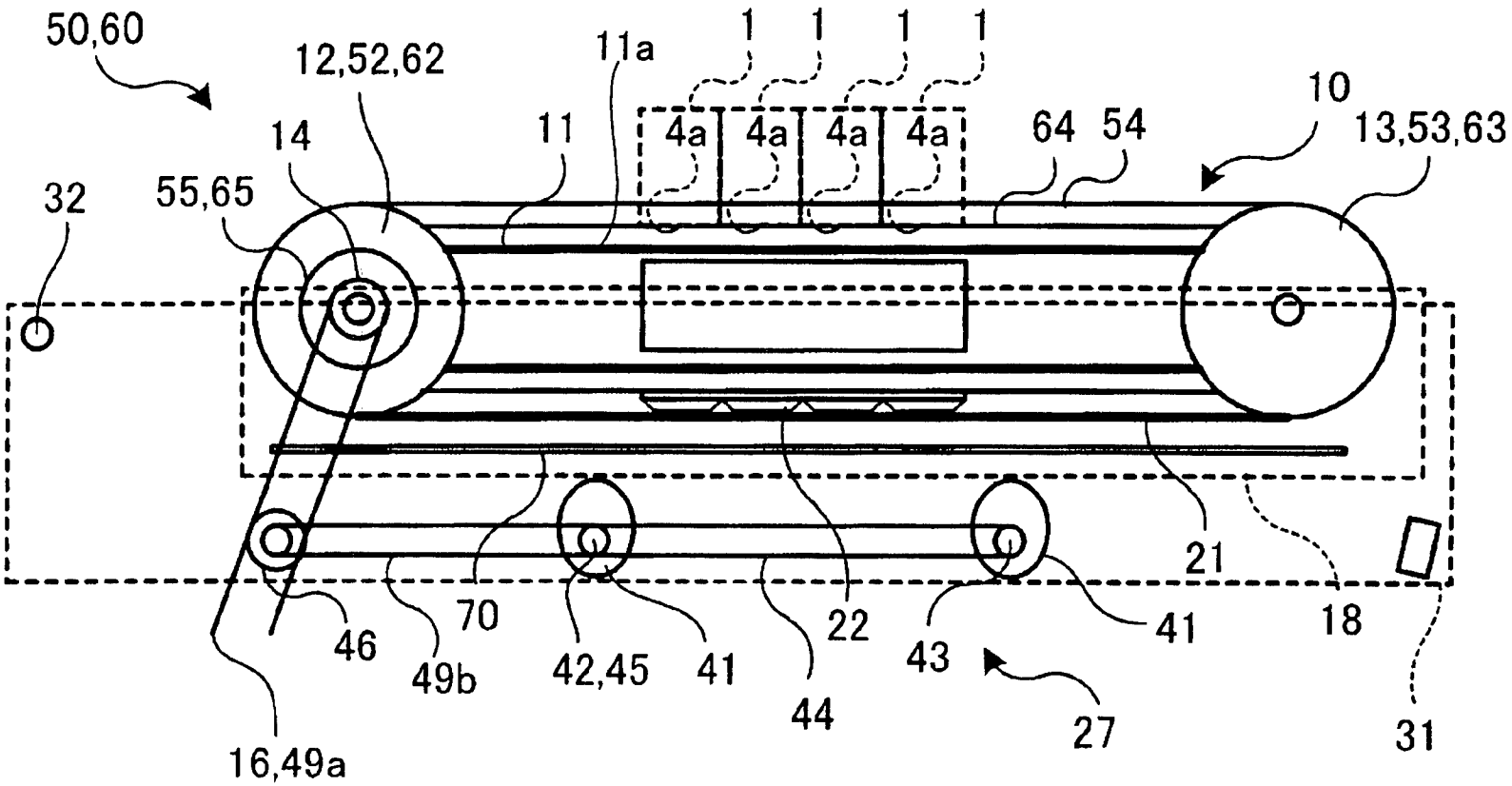
FIG. 6 shows a lift mechanism shown in FIG. 1.

The operation of the lift mechanism 27 will now be described with reference to FIG. 6. FIG. 6 shows an operating state of the lift mechanism 27. When the lift clutch 47 (not shown in FIG. 6. See FIG. 1) is driven based on a command from the controller 90, the rotational force of the feeding motor 17 (not shown in FIG. 6. See FIG. 1) is output to the output pulley 48 (not shown in FIG. 6. See FIG. 1). Thereupon, the cam shaft 42 is driven via the transfer belts 49*a* and 49*b* and the cam driving rollers 46 and 45. When the cam shaft 42 is driven, the cam shaft 43 is driven in synchrony therewith via the cam joining belt 44. When the cam shafts 42 and 43 are driven in synchrony, the four eccentric cams 41 are driven in synchrony. The change in position of the eccentric cams 41 changes the distance between the lift frame 18 and the swing frame 31. Consequently, the feeding sheet conveying mechanism 10, the ink receiving sheet conveying mechanism 50, and the capping sheet conveying mechanism 60 move in a direction orthogonal to the paper feeding direction 11*a* (i.e. the up-down direction) with respect to the swing flame 31. Thereupon, as shown in FIG. 6, when the eccentric cams 41 are rotated such that their lengthwise direction is orthogonal to the paper feeding direction 11*a*, the feeding sheet conveying mechanism 10, the ink receiving sheet conveying mechanism 50, and the capping sheet conveying mechanism 60 are raised so as to be closest to the ink jet faces 4*a*. When the eccentric cams 41 are rotated such that their lengthwise direction extends in the paper feeding direction 11*a*, the feeding sheet conveying mechanism 10, the ink receiving sheet conveying mechanism 50, and the capping sheet conveying mechanism 60 are lowered so as to be furthest from the ink jet faces 4*a*. In a normal printing state, the feeding sheet conveying mechanism 10, the ink receiving sheet conveying mechanism 50, and the capping sheet conveying mechanism 60 have been lowered by the lift mechanism 27 (see FIG. 1). When the capping sheet 22 is to be pressed onto the ink jet faces 4*a*, thus the ink jet nozzles 8 is to be protected in an airtight manner from the air, the feeding sheet conveying mechanism 10, the ink receiving sheet conveying mechanism 50, and the capping sheet conveying mechanism 60 are raised.

Figure 7:
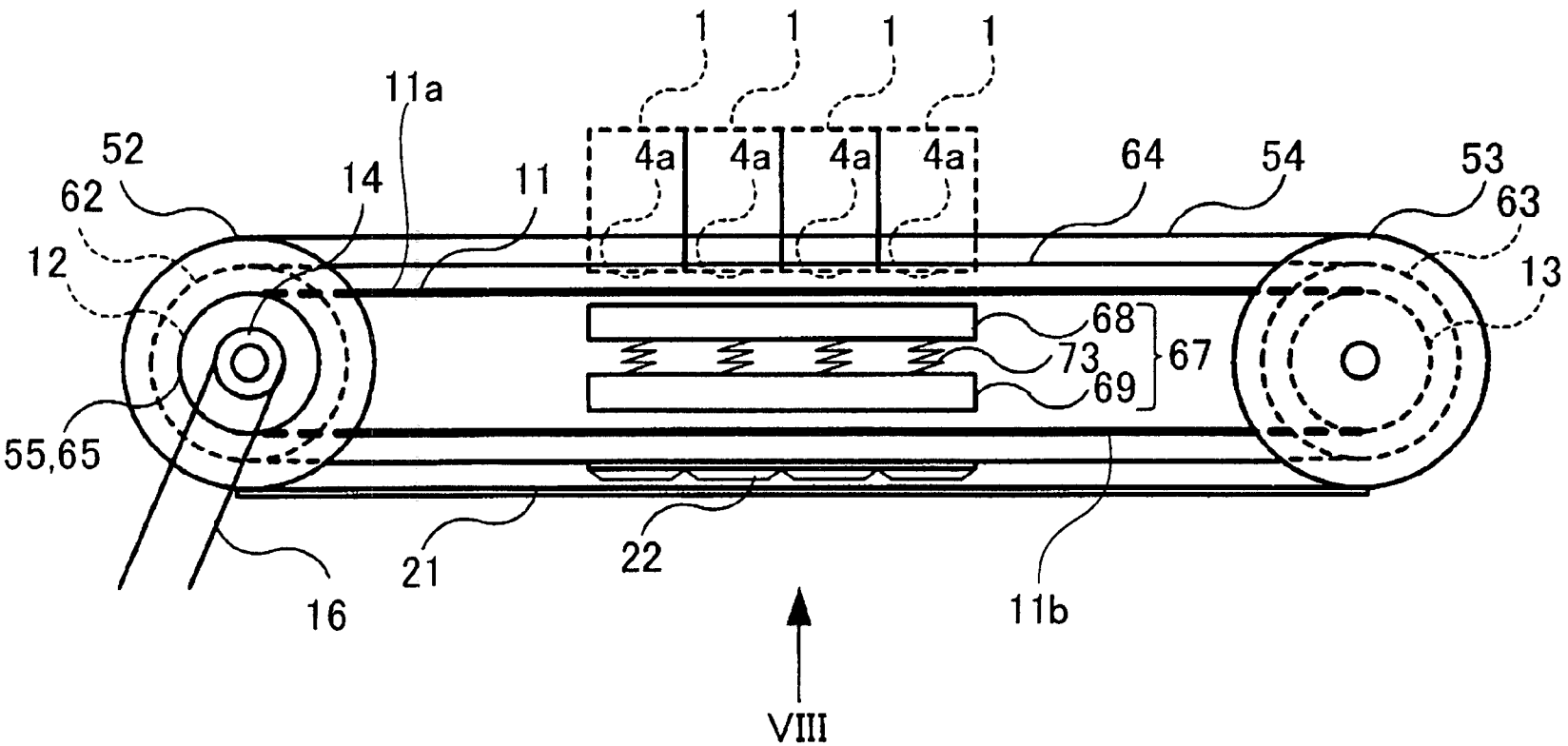
FIG. 7 shows an enlarged view of the feeding sheet conveying mechanism shown in FIG. 1.
Figure 8:
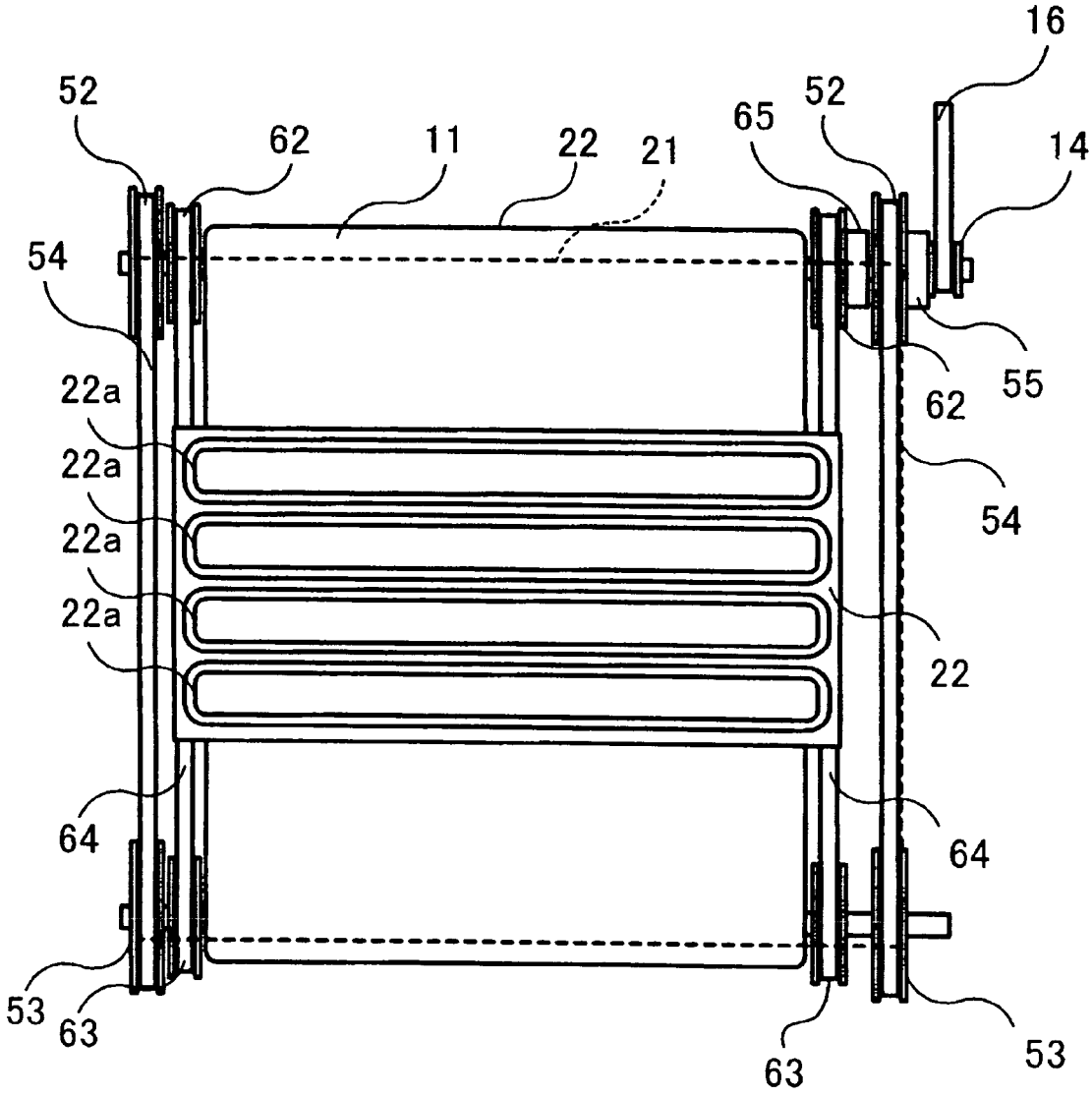
FIG. 8 shows a figure viewed from the arrow VIII in FIG. 7.

Next, the ink receiving sheet 21, the ink receiving sheet conveying mechanism 50, the capping sheet 22, and the capping sheet conveying mechanism 60 will be described with reference to FIGS. 7 and 8. FIG. 7 is an enlarged view of surroundings of the feeding sheet conveying mechanism 10 shown in FIG. 1. FIG. 8 is a figure viewed from the arrow VIII shown in FIG. 7. FIG. 8 shows a state where the ink receiving sheet 21 has been conveyed along an upper side of the feeding plane 11*a* of the feeding sheet 11. The ink receiving sheet 21 is a flexible rectangular sheet that receives ink droplets jetted from the ink jet heads 1 during the purge operation. A face of the ink receiving sheet 21 has undergone treatment to repel liquid. The ink receiving sheet conveying mechanism 50 moves the ink receiving sheet 21 based on a command from the controller 90, and includes a pair of ink receiving sheet conveying rollers 52 and 53 (a pair of second rollers), ink receiving sheet conveying belts 54 (second belts), a driving gear 55, and an ink receiving sheet driving mechanism 56. When the ink receiving sheet 21 is disposed at an ink receiving position (also termed a second position) that is opposite the ink jet faces 4*a* of the ink jet heads 1, the ink receiving sheet 21 receives ink droplets jetted from the jet ink heads 1 as will be explained referring FIG. 17.

The ink receiving sheet conveying rollers 52 and 53 convey the ink receiving sheet 21. The ink receiving sheet conveying rollers 52 and 53 are disposed coaxially at an outer side of the feeding sheet conveying rollers 12 and 13 respectively, and rotating shafts of the ink receiving sheet conveying rollers 52 and 53 are mutually parallel. An outer diameter of the ink receiving sheet conveying rollers 52 and 53 is greater than the outer diameter of the feeding sheet conveying rollers 12 and 13. Furthermore, the ink receiving sheet conveying rollers 52 and 53 are able to rotate independently with respect to the feeding sheet conveying rollers 12 and 13. The ink receiving sheet conveying belts 54 are two belts wound across the ink receiving sheet conveying rollers 52 and 53. Each of both end parts of the ink receiving sheet 21 joins with one of the ink receiving sheet conveying belts 54. The ink receiving sheet conveying belts 54 combine with the ink receiving sheet 21 to form, essentially, an endless belt.

The driving gear 55 drives the ink receiving sheet conveying roller 52, and is disposed such that it is joined coaxially with the ink receiving sheet conveying roller 52.

The ink receiving sheet driving mechanism 56 transmits the rotational force of the maintenance motor 80 to the driving gear 55 based on a command from the controller 90.

Figure 9:
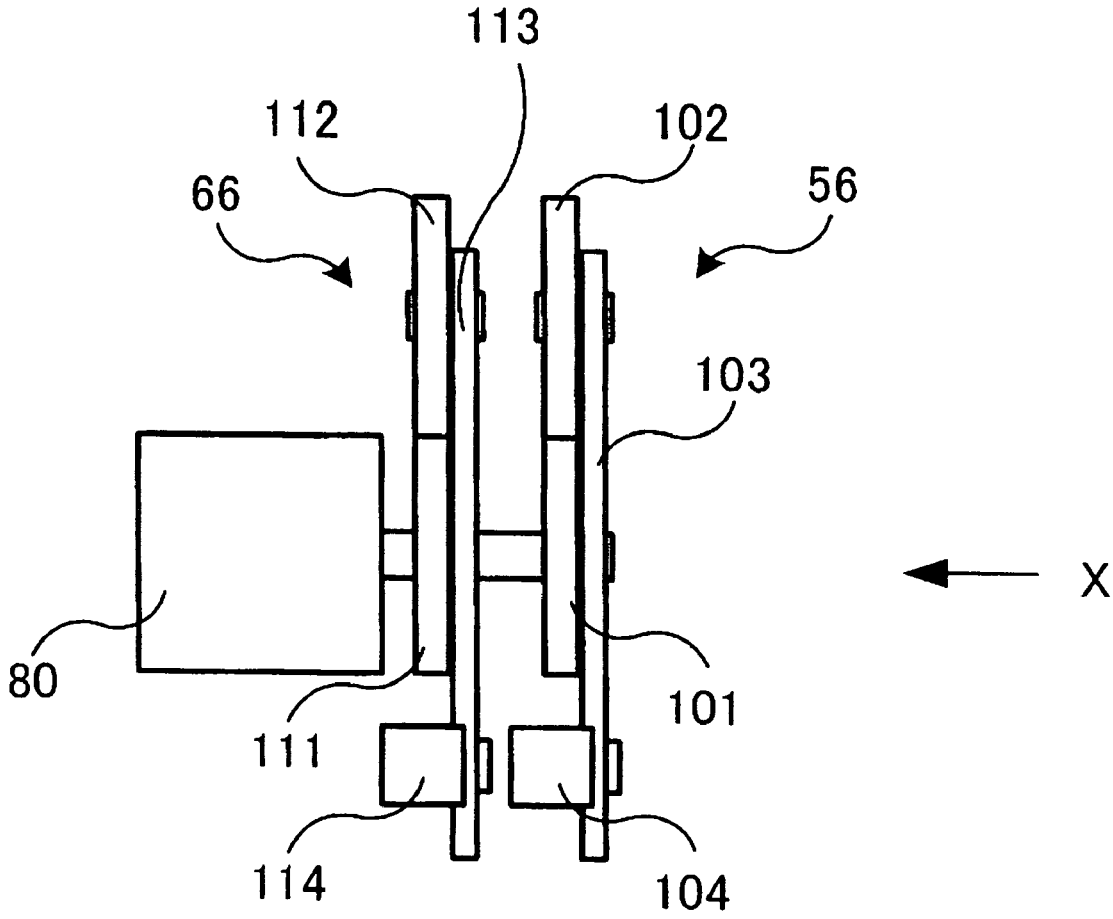
FIG. 9 shows an enlarged view of an ink receiving sheet conveying mechanism and a capping sheet conveying mechanism, both shown in FIG. 1.
Figure 10:
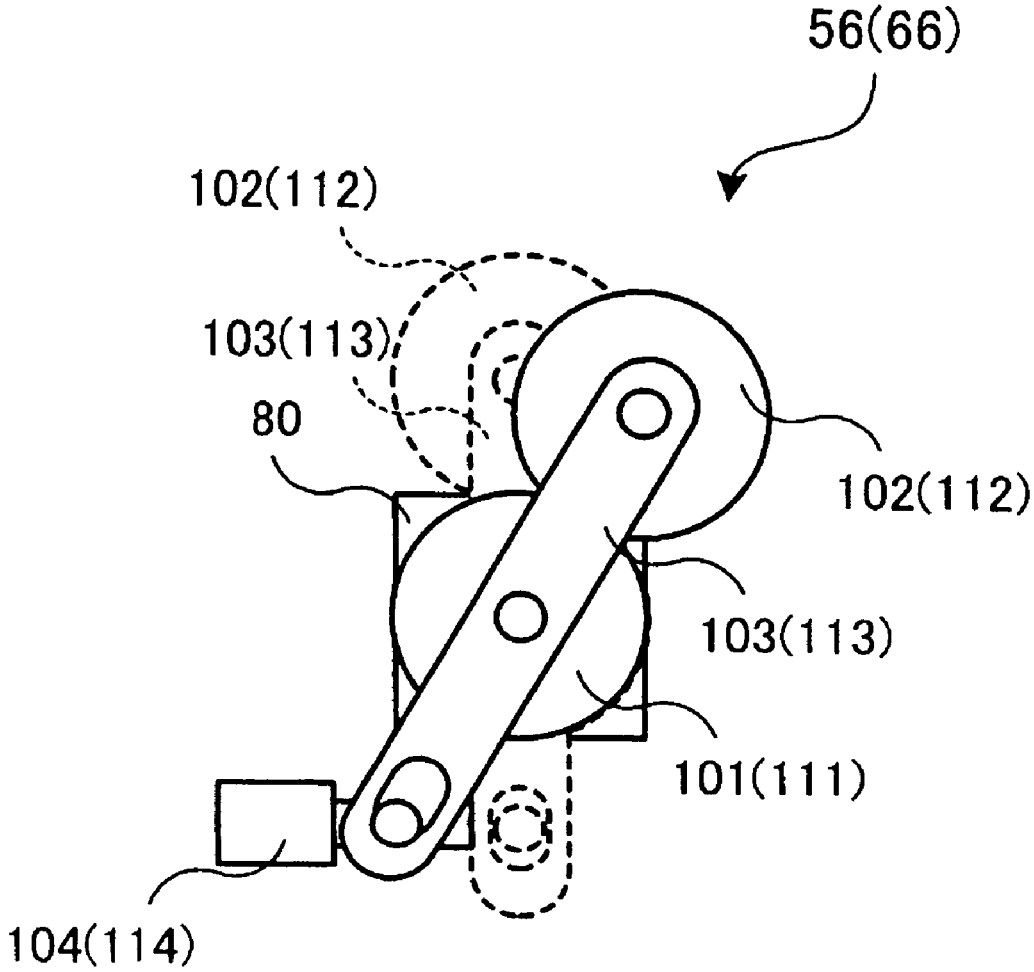
FIG. 10 shows a figure viewed from the arrow X in FIG. 9.

The ink receiving sheet driving mechanism 56 will now be described with reference to FIGS. 9 and 10. FIG. 9 is a top view of the ink receiving sheet driving mechanism 56 and a capping sheet driving mechanism 66 (to be described). FIG. 10 is a figure viewed from the arrow X in FIG. 9. As shown in FIGS. 9 and 10, the ink receiving sheet driving mechanism 56 includes a sun gear 101, a planet gear 102, a joining plate 103, and a receiving solenoid 104. The sun gear 101 is a gear connected with an output axis of the maintenance motor 80. The planet gear 102 drives the driving gear 55 when it has been engaged therewith and is disposed in a state wherein it engages with the sun gear 101. The joining plate 103 is a member that supports the planet gear 102 in a manner allowing rotation and that causes the sun gear 101 and the planet gear 102 to be joined in an engaged state. Further, the joining plate 103 is a thin sheet-shaped member that extends in one direction. The sun gear 101 is attached in the center of the joining plate 103, and the planet gear 102 is attached in an edge portion thereof. Both the sun gear 101 and the planet gear 102 are attached such that they can rotate. Moreover, a long hole is formed in the end portion of an opposing side of the joining plate 103. The receiving solenoid 104 expands or contracts based on a command from the controller 90, and an end part of the receiving solenoid 104 fits with the long hole of the joining plate 103.

The expansion of the receiving solenoid 104 causes the joining plate 103 to swing with the sun gear 101 as the center. The planet gear 102 supported in the edge portion of the joining plate 103 is thus swung around the periphery of the sun gear 101. Specifically, when the receiving solenoid 104 extends, the planet gear 102 swings in a direction away from the driving gear 55 (see the dashed line in FIG. 10). When the receiving solenoid 104 contracts, the planet gear 102 swings in a direction for engaging with the driving gear 55 (see the solid line in FIG. 10). When the maintenance motor 80 is rotating, the sun gear 101 joined therewith rotates, and the planet gear 102 engaged with the sun gear 101 rotates.

When the receiving solenoid 104 contracts based on a command from the controller 90, the planet gear 102 engages with the driving gear 55. Furthermore, when the maintenance motor 80 rotates based on a command from the controller 90, the driving gear 55 rotates via the sun gear 101 and the planet gear 102. When the driving gear 55 rotates, the ink receiving sheet conveying roller 52 and the ink receiving sheet conveying belts 54 are driven, thereby conveying the ink receiving sheet 21. The ink receiving sheet 21 is thus moved between the ink receiving position and a position allowing recording. In the ink receiving position (also termed the second position), the ink receiving sheet 21 is positioned at an upper side of the upper plane 11*a* of the endless belt-type feeding sheet 11 and is opposite the ink jet faces 4*a*. In the position allowing recording (also termed a first position), the ink receiving sheet 21 is positioned at a lower side of a lower plane 11*b* of the endless belt-type feeding sheet 11 and is not opposite the ink jet faces 4*a*.

The ink receiving sheet 21 moves along the outer side of the outer peripheral plane of the endless belt-type feeding sheet 11. A constant distance is maintained between the ink receiving sheet 21 and the feeding sheet 11.

As shown in FIGS. 7 and 8, the capping sheet 22 is disposed between the ink receiving sheet 21 and the feeding sheet 11, and may cap the ink jet faces 4*a*. The capping sheet 22 is rectangular, and four ribs 22*a* are formed on a face thereof. These ribs 22*a* extend along borders of the ink jet faces 4*a*. The capping sheet conveying mechanism 60 moves the capping sheet 22, and includes two capping sheet conveying rollers 62 and 63 (third rollers), capping sheet conveying belts 64, a driving gear 65, the capping sheet driving mechanism 66, and a cap pressing mechanism 67.

The capping sheet conveying rollers 62 and 63 are disposed coaxially at an inner side of the ink receiving sheet conveying rollers 52 and 53 respectively, and rotating shafts of the capping sheet conveying rollers 62 and 63 are mutually parallel. An outer diameter of the capping sheet conveying rollers 62 and 63 is smaller than the outer diameter of the ink receiving sheet conveying rollers 52 and 53, and is greater than the outer diameter of the feeding sheet conveying rollers 12 and 13. The capping sheet conveying rollers 62 and 63 are able to rotate independently with respect to the feeding sheet conveying rollers 12 and 13 and the ink receiving sheet conveying rollers 52 and 53. The capping sheet conveying belts 64 are two belts wound across the capping sheet conveying rollers 62 and 63. Each of both end parts of the capping sheet 22 is fixed to one of the capping sheet conveying belts 64. The capping sheet conveying belts 64 combine with the capping sheet 22 to form, essentially, an endless belt.

The driving gear 65 drives the capping sheet conveying roller 62, and is disposed such that it is joined coaxially with the capping sheet conveying roller 62. The capping sheet driving mechanism 66 transmits the rotational force of the maintenance motor 80 to the driving gear 65 based on a command from the controller 90.

The capping sheet driving mechanism 66 will now be described with further reference to FIGS. 9 and 10. The capping sheet driving mechanism 66 has essentially the same configuration as the ink receiving sheet driving mechanism 56. As shown in FIGS. 9 and 10, the capping sheet driving mechanism 66 includes a sun gear 111, a planet gear 112, a joining plate 113, and a capping solenoid 114. The sun gear 111 is connected with the output axis of the maintenance motor 80. The planet gear 112 drives the driving gear 65 when it is engaged therewith and is disposed in a state wherein it engages with the sun gear 111. The joining plate 113 is a member that supports the planet gear 112 in a manner allowing swinging, and that causes the sun gear 111 and the planet gear 112 to be joined in an engaged state. Further, the joining plate 113 is a thin sheet-shaped member that extends in one direction. The sun gear 111 is attached in the center of the joining plate 113, and the planet gear 112 is attached in an edge portion thereof. Both the sun gear 111 and the planet gear 112 are attached such that they can rotate. Moreover, a long hole is formed in the end portion of an opposing side of the joining plate 113. The capping solenoid 114 expands or contracts based on a command from the controller 90, and an end part of the capping solenoid 114 fits with the long hole of the joining plate 113.

As a result, the expansion of the capping solenoid 114 causes the joining plate 113 to swing with the sun gear 111 as the center. The planet gear 112 supported in the edge portion of the joining plate 113 is thus swung around the periphery of the sun gear 111. Specifically, when the capping solenoid 114 extends, the planet gear 112 swings in a direction away from the driving gear 65. When the capping solenoid 114 contracts, the planet gear 112 swings in a direction for engaging with the driving gear 65. When the maintenance motor 80 is rotating, the sun gear 111 joined therewith rotates, and the planet gear 112 engaged with the sun gear 111 rotates.

When the capping sheet 22 has been pressed onto the ink jet faces 4*a* (this will be described later), the cap pressing mechanism 67 (shown in FIG. 7) efficiently transfers the pressing force to the ink jet faces 4*a*. The cap pressing mechanism 67 is disposed at an inner side of the ring-shaped endless belt-type feeding sheet 11 such that it is opposite the ink jet faces 4*a*. Further, the cap pressing mechanism 67 includes an upper sheet 68 disposed at the ink jet face 4*a* side, a lower sheet 69 disposed at the opposite side from the upper sheet 68, and a plurality of springs 73 disposed between the upper sheet 68 and the lower sheet 69. The lower sheet 69 is fixed to the lift frame 18.

When the capping solenoid 114 contracts based on a command from the controller 90, the planet gear 112 engages with the driving gear 65. Furthermore, when the maintenance motor 80 rotates based on a command from the controller 90, the driving gear 65 rotates via the sun gear 111 and the planet gear 112. When the driving gear 65 rotates, the capping sheet conveying roller 62 and the capping sheet conveying belts 64 are driven, thus conveying the capping sheet 22. The capping sheet 22 is thus moved between a capping position and a non-capping position, In the capping position (also termed a fifth position), the capping sheet 22 is positioned at the upper side of the upper plane 11*a* of the endless belt-type feeding sheet 11 and is opposite the ink jet faces 4*a*. In the non-capping position (also termed a sixth position), the capping sheet 22 is positioned at the lower side of the lower plane 11*b* of the endless belt-type feeding sheet 11 and is not opposite the ink jet faces 4*a*.

The capping sheet 22 moves along the outer side of the outer peripheral plane of the endless belt-type feeding sheet 11. Further, the capping sheet 22 moves along an inner side of an inner peripheral plane of the ink receiving sheet 21. A constant distance is maintained between the capping sheet 22 and the feeding sheet 11.

As shown in FIG. 1, the sheet cover 70 is fixed to the lift frame 18. The sheet cover 70 receives ink running down from the ink receiving sheet 21 that is disposed in the position allowing recording (the first position). When the feeding sheet conveying mechanism 10 has been moved by the unit moving mechanism 30 to the retreated position (the forth position), the sheet cover 70 is inclined with respect to the ink jet faces 4*a*. The sheet cover 70 is lowered at the paper discharge side.

Figure 11:
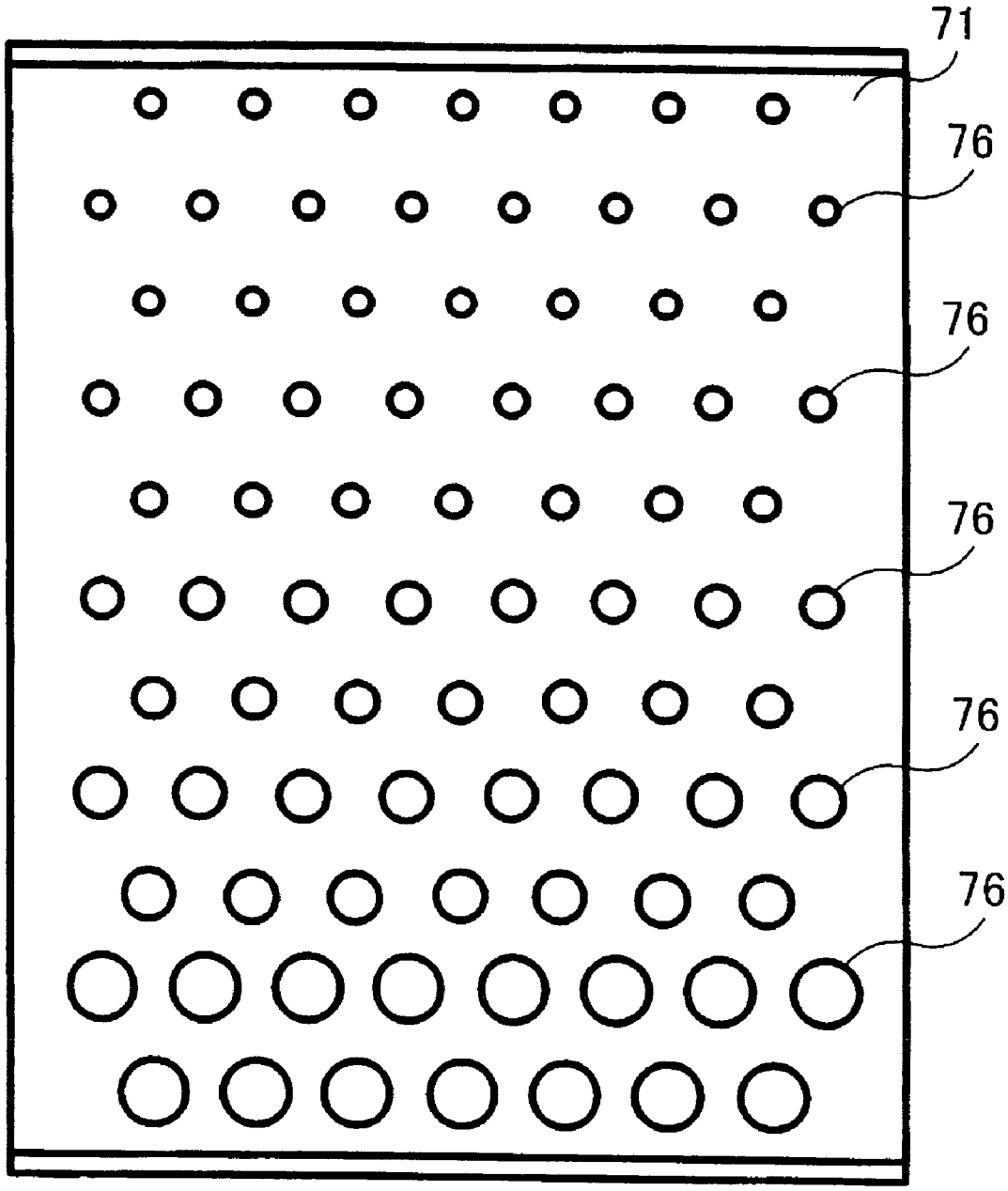
FIG. 11 shows a figure of an ink tray shown in FIG. 1 viewed from the feeding sheet conveying mechanism side.

The ink tray 71 will now be described with reference to FIG. 11. FIG. 11 shows the ink tray 71 viewed from the feeding sheet conveying mechanism 10 side. As shown in FIGS. 1 and 11, when the feeding sheet conveying mechanism 10 has been moved to the retreated position (the fourth position), the ink tray 71 receives ink running down from the ink receiving sheet 21 during the purge operation (to be described). The ink tray 71 has a rectangular shape and extends from the paper discharge side to the supply side. The ink tray 71 is disposed below the ink receiving sheet 21 and inclines downwards from the paper discharge side to the supply side. A plurality of ink flow holes 76 are formed in a base face of the ink tray 71. The diameter of the ink flow holes 76 gradually increases from the paper discharge side to the supply side. The area of the ink flow holes 76 per unit area of the ink tray 71 gradually increases from the paper discharge side to the supply side.

The ink tank 72 shown in FIG. 1 is disposed below the ink tray 71, and collects the ink running down from the ink flow holes 76 of the ink tray 71. A material (not shown) that absorbs ink is disposed within the ink tank 72.

The ink tank 72 is removable with respect to the main body frame 201, and can easily be exchanged.

Figure 12:
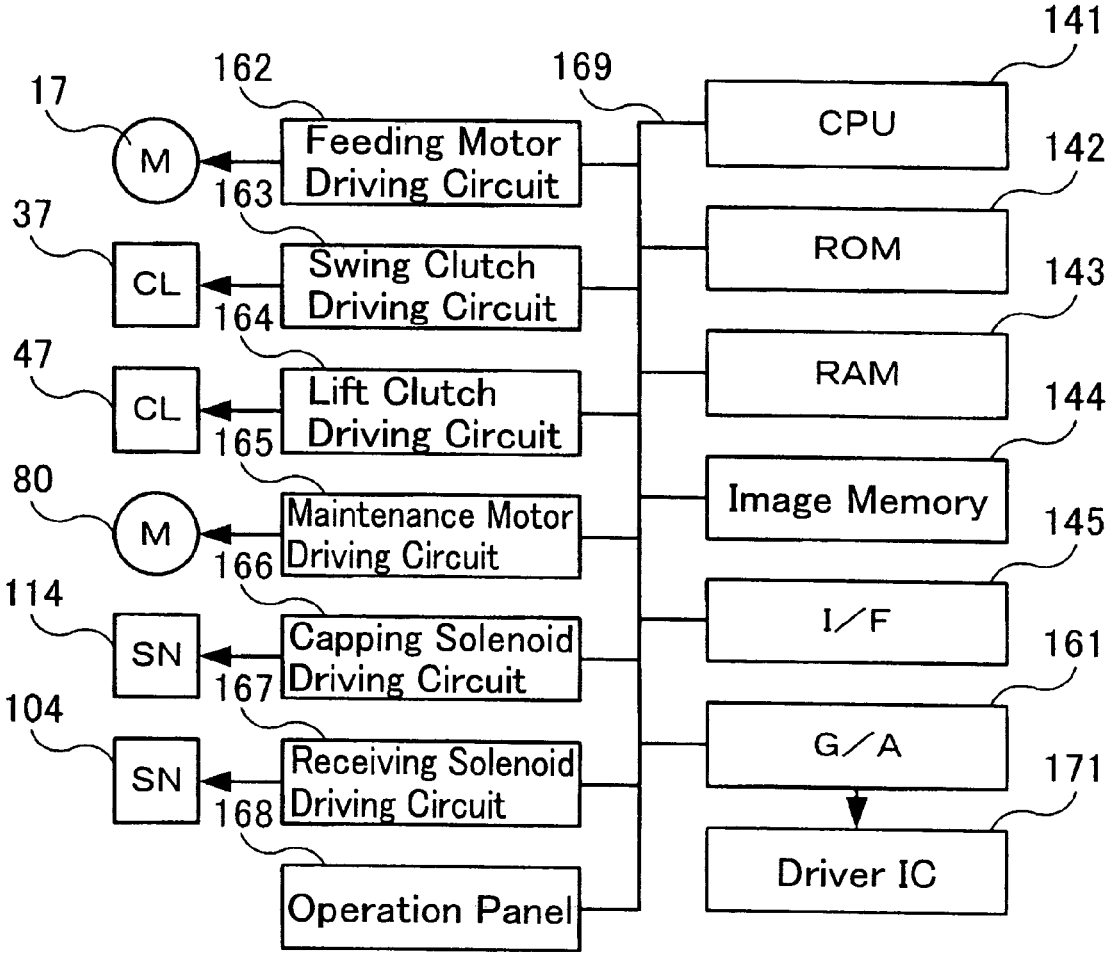
FIG. 12 shows internal configuration of a controller shown in FIG. 1.

Next, internal structure of the controller 90 will be described with respect to FIG. 12. FIG. 12 is a block diagram showing the internal structure of the controller 90. As shown in FIG. 12, the controller 90 is provided with a CPU (Central Processing Unit) 141, a ROM (Read Only Memory) 142, a RAM (Random-Access Memory) 143, an image memory 144, an interface 145, a G/A 161, a feeding motor driving circuit 162, a swing clutch driving circuit 163, a lift clutch driving circuit 164, a maintenance motor driving circuit 165, a capping solenoid driving circuit 166, a receiving solenoid driving circuit 167, an operation panel 168, and a data bus 169 that connects all of the above.

The CPU 141 executes processes as directed by various commands. The ROM 142 is a nonvolatile memory that stores programs, etc. including commands to be processed by the CPU 141. The CPU 141 can control the ink jet printer 100 by sequentially executing programs stored in the ROM 142. The RAM 143 is a volatile memory for the temporary storage of data used while the CPU 141 is executing programs. The image memory 144 is a memory for storing data of images to be printed by the ink jet printer 100. The interface 145 is connected with an external device such as a computer or the like. The G/A 161 outputs a signal to a driver IC 171 provided in each ink jet head 1 so as to drive the actuator units 5 of the ink jet heads 1 so as to print the image data.

The feeding motor driving circuit 162 drives the feeding motor 17. The swing clutch driving circuit 163 drives the swing clutch 37, the lift clutch driving circuit 164 drives the lift clutch 47, and the maintenance motor driving circuit 165 drives the maintenance motor 80. The capping solenoid driving circuit 166 drives the capping solenoid 114. The receiving solenoid driving circuit 167 drives the receiving solenoid 104. The operation panel 168 is a user interface allowing a user to operate the ink jet printer 100. The data bus 169 is a plurality of lines for transmitting data, and electrically connects each of the aforementioned units. All of the data in the controller 90 is transmitted via the data bus 169.

Figure 13:
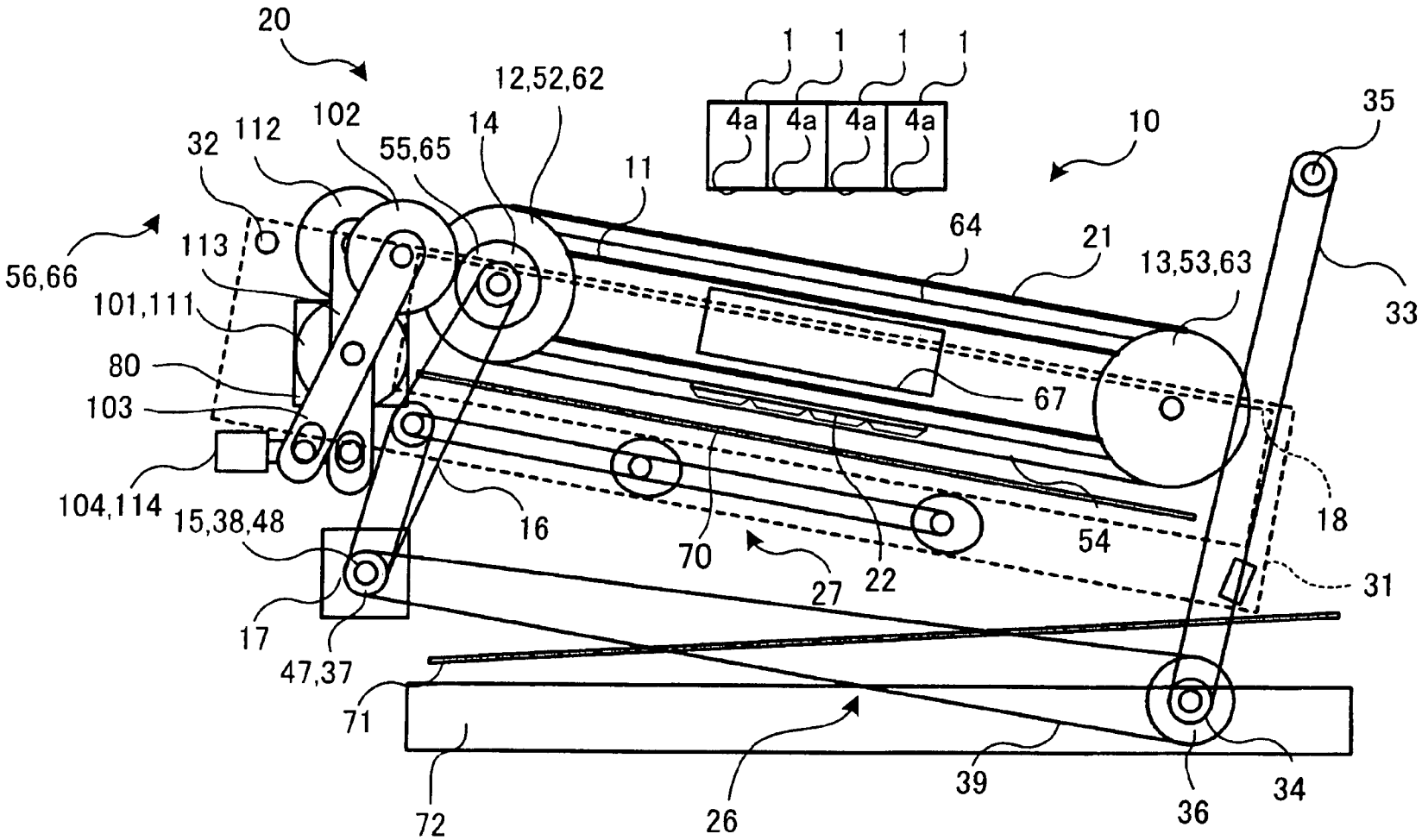
FIG. 13 shows a purge operation of a maintenance mechanism shown in FIG. 1.
Figure 14:
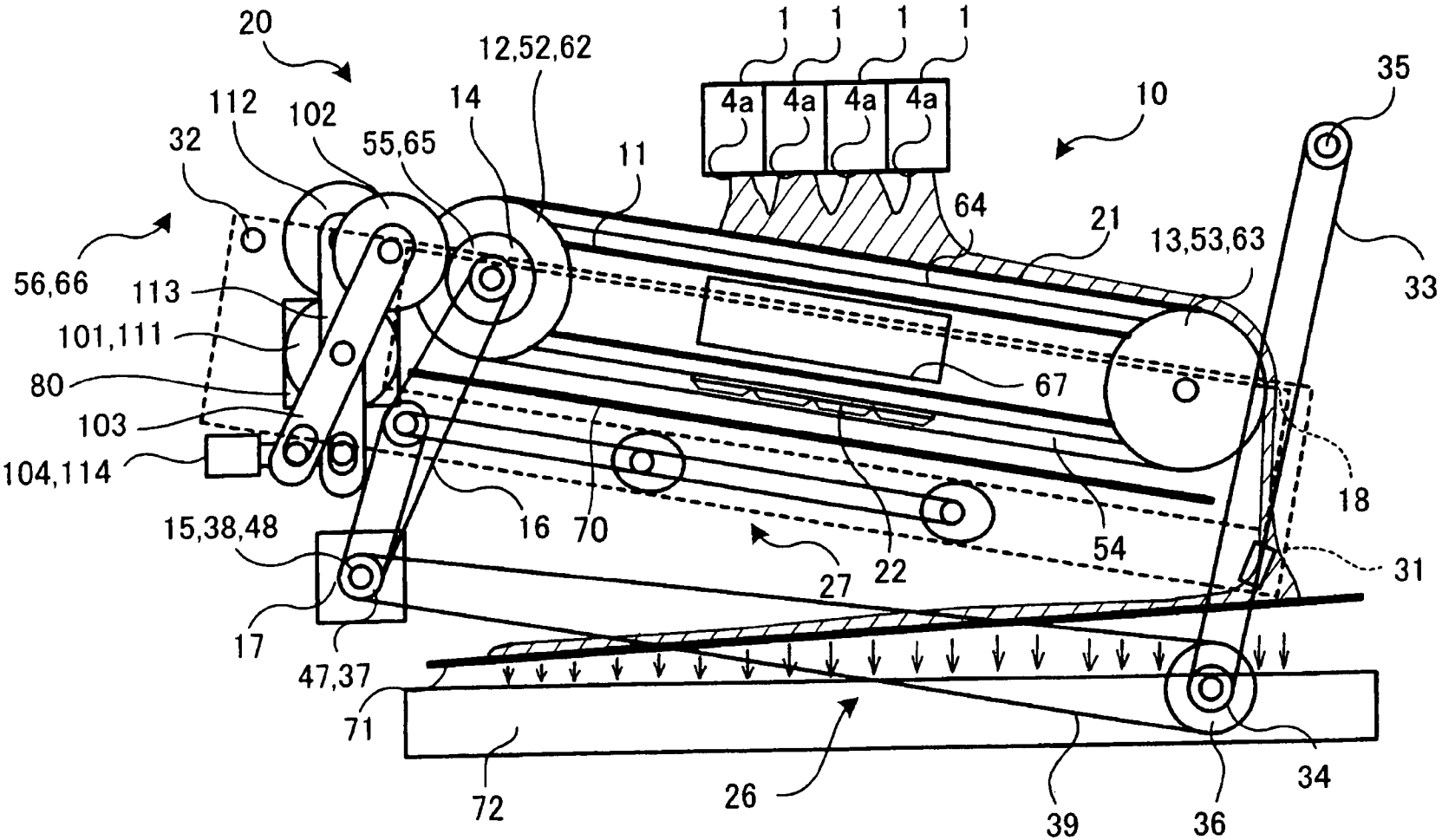
FIG. 14 shows the purge operation of the maintenance mechanism shown in FIG. 1.

Next, the operation of the maintenance mechanism 20 will be described with reference to figures. The maintenance mechanism 20 can perform the purge operation, a capping operation, and the purge operation followed immediately by the capping operation. The purge operation will be described with reference to FIG. 1, FIG. 13, and FIG. 14. FIGS. 13 and 14 show the purge operation. In the purge operation, ink is jetted from all the ink jet nozzles 8 of the ink jet heads 1, thus extremely viscous ink, impurities or bubbles in the ink jet heads 1 are discharged. Since jetting characteristics of the ink droplets are disturbed when extremely viscous ink adheres to the interior of the ink jet heads 1, or when impurities or bubbles are present in the ink jet heads 1, satisfactory printing quality cannot be obtained, and the purge operation needs to be executed.

In the normal printing state shown in FIG. 1, the swing frame 31 and the feeding sheet conveying mechanism 10 have been located at a feeding position (the third position) by the swing mechanism 26, and the lift frame 18 and the feeding sheet conveying mechanism 10 have been lowered by the lift mechanism 27. Furthermore, the ink receiving sheet 21 has been located at the position allowing recording (the first position) by the ink receiving sheet conveying mechanism 50. The capping sheet 22 has been located at the non-capping position (the sixth position) by the capping sheet conveying mechanism 60. At this time, the planet gear 102 of the ink receiving sheet driving mechanism 56 is located in a position where it does not engage with the driving gear 55. The planet gear 112 of the capping sheet driving mechanism 66 is located in a position where it does not engage with the driving gear 65.

When, during this normal printing state, the controller 90 decides to perform the purge operation, the controller 90 drives the swing mechanism 26, thus moving the feeding sheet conveying mechanism 10 from the feeding position (the third position) to the retreated position (the fourth position), as shown in FIG. 13. That is, the controller 90 drives the swing clutch 37, thus causing the output axis of the feeding motor 17 and the output pulley 38 to join, and the controller 90 drives the feeding motor 17 until the feeding sheet conveying mechanism 10 has been swung to the retreated position (the fourth position). Then, the controller 90 drives the ink receiving sheet conveying mechanism 50, thus moving the ink receiving sheet 21 from the position allowing recording (the first position) to the ink receiving position (the second position). That is, the controller 90 drives the receiving solenoid 104 to contract, the planet gear 102 is thus swung so as to engage with the driving gear 55 and, in this state, the maintenance motor 80 continues the driving operation until the ink receiving sheet 21 is located at the ink receiving position. When the swing frame 31 and the feeding sheet conveying mechanism 10 are thus located at the retreated position, and the ink receiving sheet 21 is thus located at the ink receiving position, the ink receiving sheet 21 and the sheet cover 70 are inclined along the feeding plane 11*a* of the endless belt-type feeding sheet 11, and are inclined downwards towards the paper discharge side.

Next, as shown in FIG. 14, the controller 90 drives the actuator unit 5 of the ink jet heads 1 to jet ink from all the ink jet nozzles 8. The ink that has been jetted from the ink jet nozzles 8 is received temporarily by the ink receiving sheet 21 that is disposed in the ink receiving position. Then, because the ink receiving sheet 21 is inclined downwards towards the paper discharge side, the ink that has been received by the ink receiving sheet 21 runs down a surface of the ink receiving sheet 21 towards the paper discharge side. This ink runs off an edge of the feeding sheet conveying mechanism 10 and is received by the ink tray 71. The ink that has been received by the ink tray 71 flows along the inclination thereof towards the supply side and runs down to the ink tray. The ink on the ink tray 71 runs down through the ink flow holes 76 to the ink tank 72.

When all the ink on the ink receiving sheet 21 has run down, the sequence is performed in reverse to return the ink jet printer 100 to the normal printing state. First the controller 90 drives the ink receiving sheet conveying mechanism 50, thus moving the ink receiving sheet 21 from the ink receiving position (the second position) to the position allowing recording (the first position). That is, the controller 90 drives the maintenance motor 80 until the ink receiving sheet 21 is located at the position allowing recording. Then, the controller 90 drives the receiving solenoid 104 to expand, and the planet gear 102 is thus swung so as to disengage with the driving gear 55. When the ink receiving sheet 21 is located at the position allowing recording, the controller 90 drives the swing mechanism 26, thus moving the swing frame 31 and the feeding sheet conveying mechanism 10 from the retreated position (the fourth position) to the feeding position (the third position). That is, the controller 90 drives the feeding motor 17 until the feeding sheet conveying mechanism 10 has been moved to the feeding position. When the feeding sheet conveying mechanism 10 is located at the feeding position, the controller 90 drives the swing clutch 37, thus causing the output axis of the feeding motor 17 and the swing output pulley 38 to separate. The purge operation is now completed.

Figure 15:
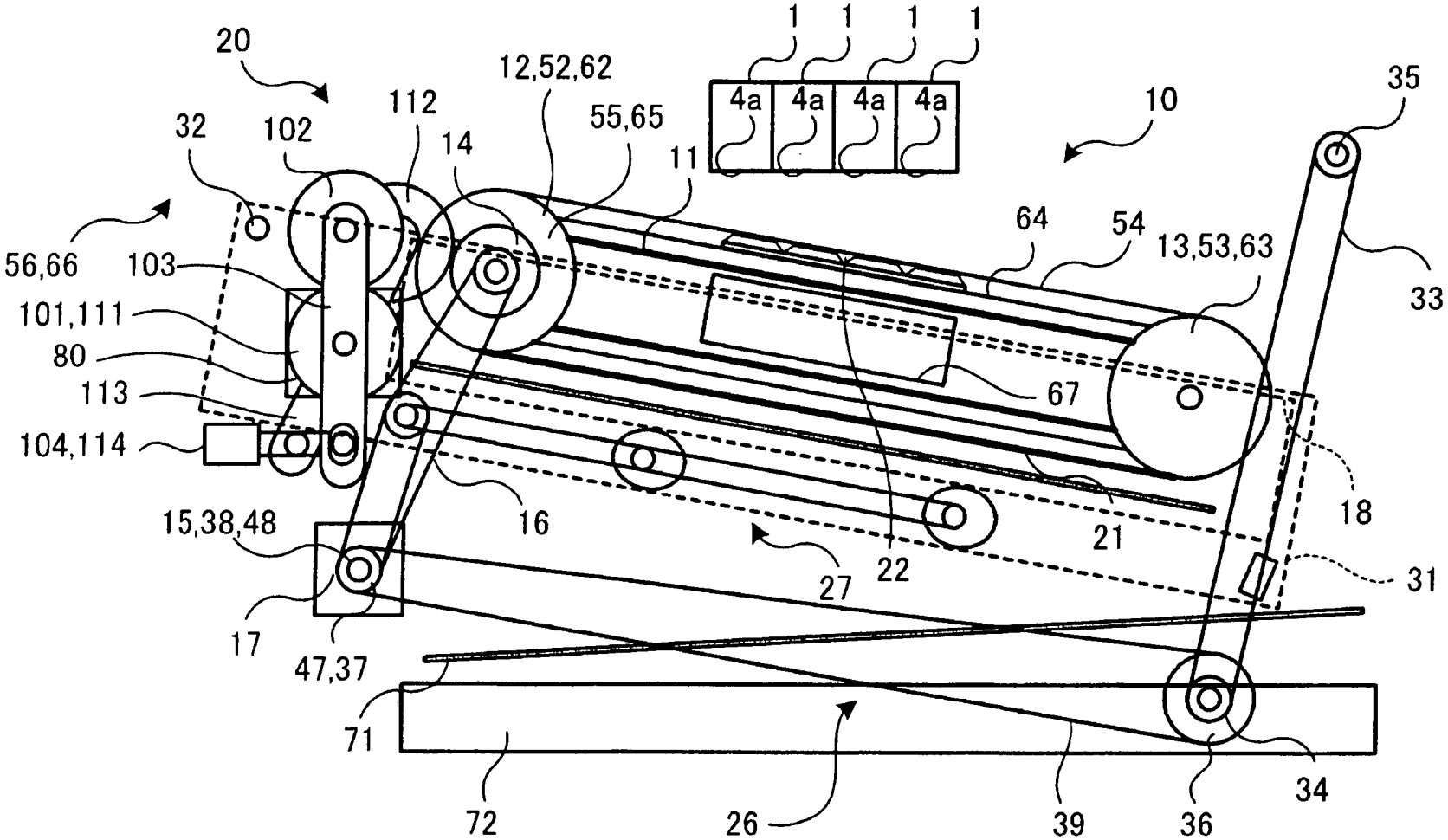
FIG. 15 shows a capping operation of the maintenance mechanism shown in FIG. 1.
Figure 16:
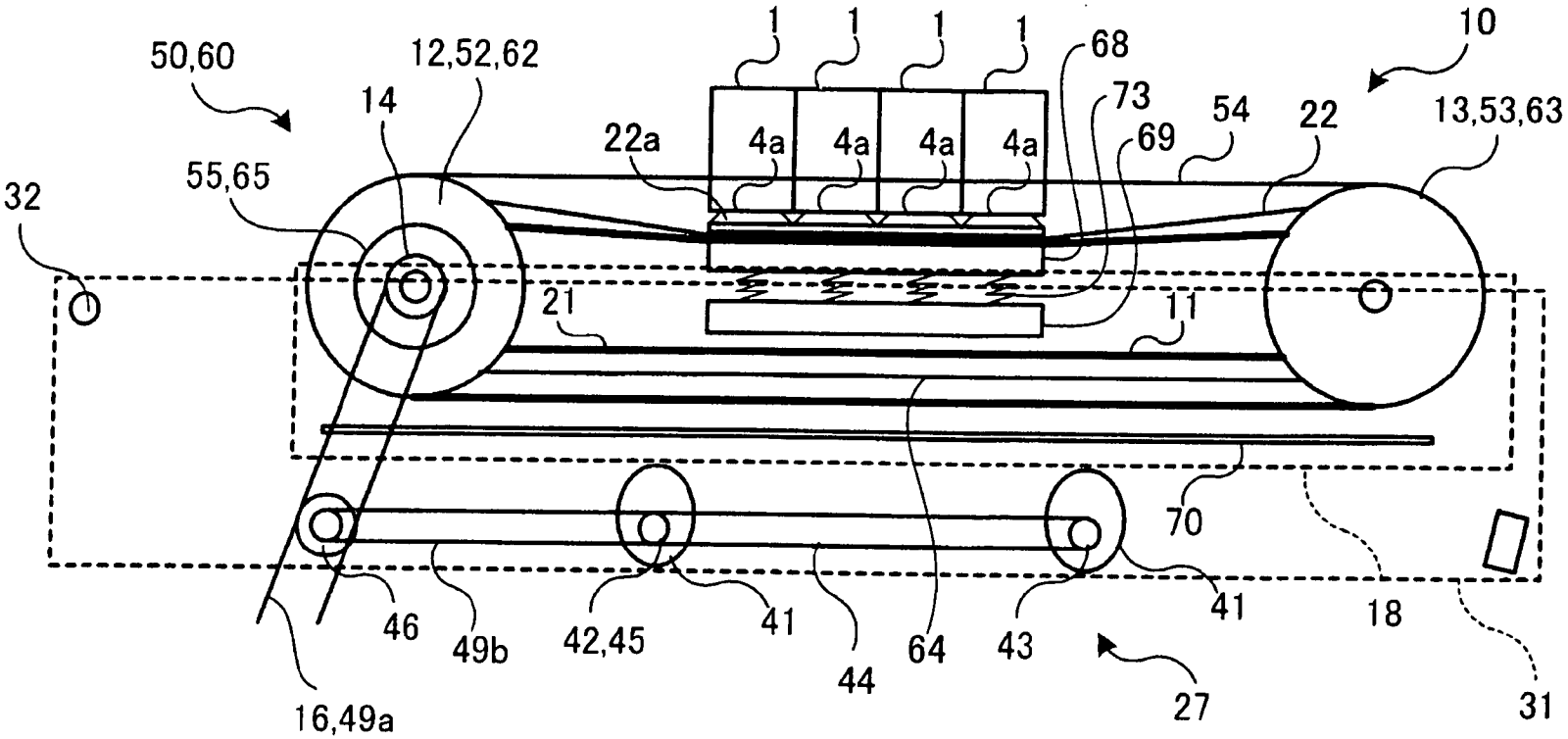
FIG. 16 shows the capping operation of the maintenance mechanism shown in FIG. 1.

Next, the capping operation will be described with reference to FIGS. 15 and 16. FIGS. 15 and 16 show the capping operation. The capping operation is an operation to seal the ink jet faces 4*a* of the ink jet heads 1 by means of the capping sheet 22. In the case where the ink jet printer is disconnected from a power source and the ink is not jetted for a long time, the ink jet faces 4*a* needs to be sealed from the air so as to prevent the ink in the ink jet nozzles 8 from drying out, becoming more viscous, and thereby blocking the ink jet nozzles.

In the normal printing state, when the controller 90 decides to perform the capping operation, the controller 90 drives the swing mechanism 26, thus moving the feeding sheet conveying mechanism 10 from the feeding position (the third position) to the retreated position (the fourth position), as shown in FIG. 15. That is, the controller 90 drives the swing clutch 37, thus causing the output axis of the feeding motor 17 and the output pulley 38 to join, and the controller 90 drives the feeding motor 17 until the feeding sheet conveying mechanism 10 is located at the retreated position. When the feeding sheet conveying mechanism 10 is located at the retreated position, the controller 90 drives the swing clutch 37, thus causing the output axis of the feeding motor 17 and the output pulley 38 to separate. Next, the controller 90 drives the capping sheet conveying mechanism 60, thus moving the capping sheet 22 from the non-capping position (the sixth position) to the capping position (the fifth position). That is, the controller 90 drives the capping solenoid 114 to contract, the planet gear 112 is thus swung so as to engage with the driving gear 65 and, in this state, the controller 90 drives the maintenance motor 80 until the capping sheet 22 is located at the capping position.

As shown in FIG. 16, when the capping sheet 22 is located at the capping position, the controller 90 drives the swing mechanism 26, thus moving the swing frame 31 and the feeding sheet conveying mechanism 10 from the retreated position to the feeding position. That is, the controller 90 drives the feeding motor 17 until the feeding sheet conveying mechanism 10 is located at the feeding position. When the feeding sheet conveying mechanism 10 is at the feeding position, the capping sheet 22 is opposite the ink jet faces 4*a*. Next, the controller 90 drives the lift mechanism 27, thus moving the lift frame 18 and the feeding sheet conveying mechanism 10 from a lower position to a higher position. That is, the controller 90 drives the lift clutch 47, thus causing the output axis of the feeding motor 17 and the output pulley 48 to join, and the controller 90 drives the feeding motor 17 until the feeding sheet conveying mechanism 10 is located at the higher position. Thereupon, the capping sheet 22 is between the ink jet face 4*a* and the upper sheet 68 of the cap pressing mechanism 67, and the capping sheet 22 is pressed onto the ink jet faces 4*a*. At this time, energized force of the springs 73 of the cap pressing mechanism 67 press the capping sheet 22 onto the ink jet faces 4*a* with appropriate force. The ribs 22*a* of the capping sheet 22 thus fit tightly with the borders of the ink jet faces 4*a* and seal them securely.

When the controller 90 decides to release this capping, the sequence is performed in reverse to return the ink jet printer 100 to the normal printing state. First the controller 90 drives the lift mechanism 27, thus moving the lift frame 18 and the feeding sheet conveying mechanism 10 from the higher position to the lower position. That is, the controller 90 drives the feeding motor 17 until the feeding sheet conveying mechanism 10 is located at the lower position. When the feeding sheet conveying mechanism 10 is at the lower position, the controller 90 drives the lift clutch 47, thus causing the output axis of the feeding motor 17 and the output pulley 48 to separate. Next, the controller 90 drives the swing mechanism 26, thus moving the swing frame 31 and the feeding sheet conveying mechanism 10 from the feeding position to the retreated position. That is, the controller 90 drives the swing clutch 37, thus causing the output axis of the feeding motor 17 and the output pulley 38 to join, and drives the feeding motor 17 until the swing frame 31 and the feeding sheet conveying mechanism 10 are located at the retreated position. Then, the controller 90 drives the capping sheet conveying mechanism 60, thus moving the capping sheet 22 to the non-capping position. That is, the controller 90 drives the maintenance motor 80 until the capping sheet 22 is located at the non-capping position. When the capping sheet 22 is at the non-capping position, the controller 90 again drives the swing mechanism 26, thus moving the feeding sheet conveying mechanism 10 to the feeding position. The capping operation is now completed.

Figure 17:
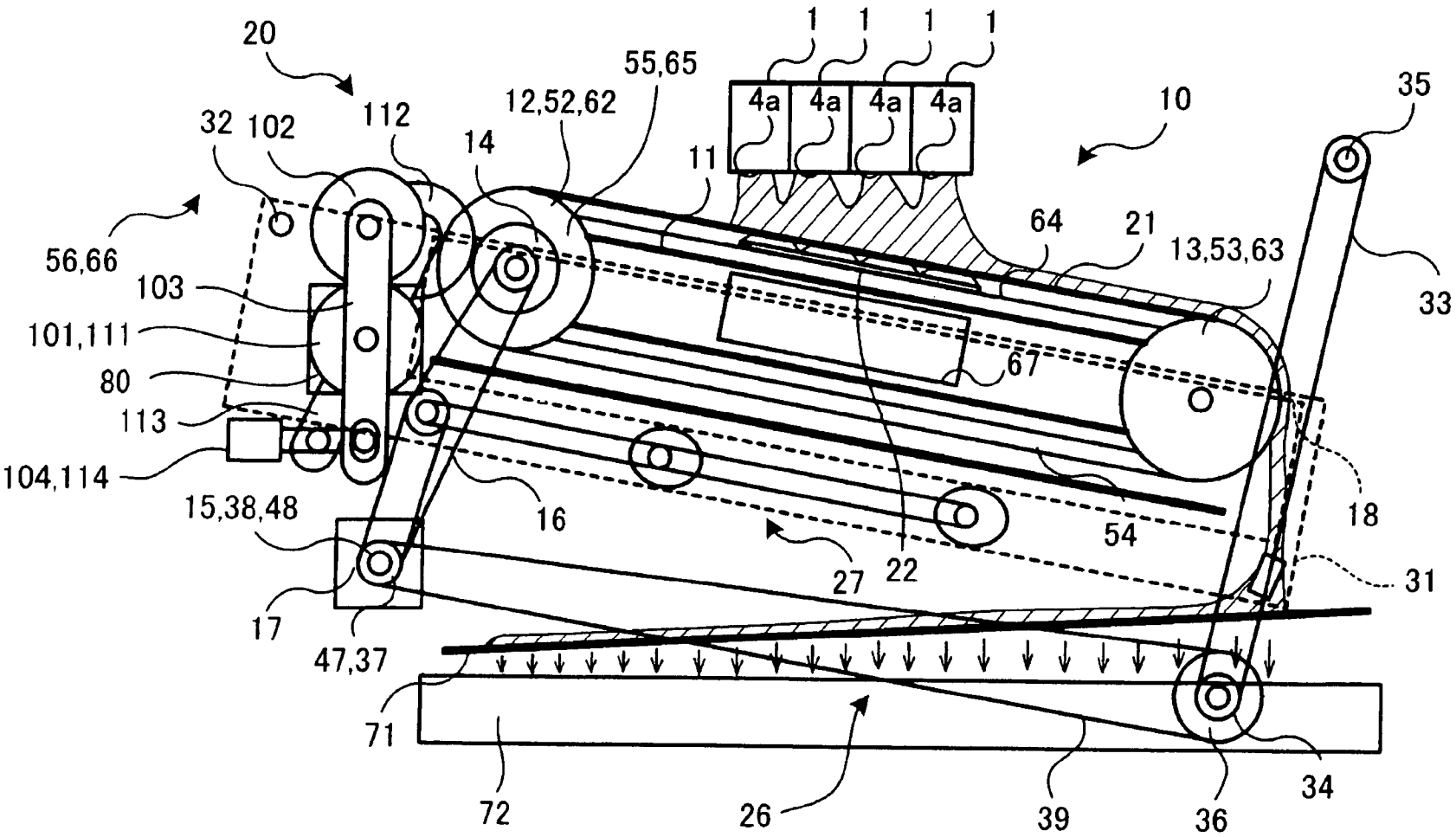
FIG. 17 shows the purge operation immediately followed by the capping operation, performed by the maintenance mechanism shown in FIG. 1.

Next, the purge operation followed immediately by the capping operation will be described with reference to FIG. 17. FIG. 17 shows the purge operation immediately followed by the capping operation. When, during the normal printing state, the controller 90 decides to perform the purge operation followed immediately by the capping operation, the controller 90 first drives the swing mechanism 26, thereby moving the swing frame 31 and the feeding sheet conveying mechanism 10 from the feeding position to the retreated position, as shown in FIG. 17. That is, the controller 90 drives the swing clutch 37, thereby causing the output axis of the feeding motor 17 and the swing output pulley 38 to join, and the controller 90 drives the feeding motor 17 until the feeding sheet conveying mechanism 10 is located at the retreated position. Next, the controller 90 drives the ink receiving sheet conveying mechanism 50, thereby moving the ink receiving sheet 21 from the position allowing recording to the ink receiving position. The controller 90 also drives the capping sheet conveying mechanism 60, thereby moving the capping sheet 22 from the non-capping position to the capping position. That is, the controller 90 drives the receiving solenoid 104 and the capping solenoid 114 to contract, whereupon the planet gear 102 is swung so as to engage with the driving gear 55, and the planet gear 112 is swung so as to engage with the driving gear 65. Then, the controller 90 drives the maintenance motor 80 until the ink receiving sheet 21 is located at the ink receiving position and the capping sheet 22 is located at the capping position. When the feeding sheet conveying mechanism 10 is located at the retreated position, and the ink receiving sheet 21 is located at the ink receiving position, the ink receiving sheet 21 is inclined along the feeding plane 11*a* of the endless belt-type feeding sheet 11, and is inclined downwards towards the paper discharge side. Thereupon, as described above, the controller 90 drives the actuator unit 5 of the ink jet heads 1 to jet a large quantity of ink from all the ink jet nozzles 8. When all the ink has run off the ink receiving sheet 21, the controller 90 drives the ink receiving sheet conveying mechanism 50, thereby moving the ink receiving sheet 21 to the position allowing recording. Next, the capping operation is performed. This is identical with the capping operation described above. The purge operation followed immediately by the capping operation is now completed.

According to the form of the embodiment described above, during the purge operation the ink receiving sheet 21 is inclined along the feeding plane 11*a* of the feeding sheet conveying mechanism 10, and consequently the ink received by the ink receiving sheet 21 runs down the ink receiving sheet 21. It is consequently not necessary to exchange the ink receiving sheet 21, and time-consuming maintenance can therefore be reduced. Furthermore, the unit moving mechanism 30 moves the feeding sheet conveying mechanism 10 such that the feeding plane 11*a* of the feeding sheet 11 is inclined with respect to the ink jet faces 4*a*. Consequently, less space can be used for moving the feeding sheet conveying mechanism 10 than in the case where the feeding sheet conveying mechanism 10 is moved such that the feeding plane 11*a* of the feeding sheet 11 is parallel to the ink jet face 4*a*. It is thus possible to save space within the ink jet printer 100.

In the present representative embodiment, the feeding sheet conveying mechanism 10 has a simple configuration wherein the endless belt-type feeding sheet 11 is wound across the feeding sheet conveying rollers 12 and 13. As a result, the feeding sheet conveying mechanism 10 can be moved easily.

Moreover, in the present embodiment, the swing mechanism 26 swings the feeding sheet conveying mechanism 10 with the swing axis 32 as the center. As a result, the feeding sheet conveying mechanism 10 can be positioned accurately at the feeding position and the retreated position.

Furthermore, in the present embodiment, the ink receiving sheet conveying mechanism 50 moves the ink receiving sheet 21 along the rotational locus of the endless belt-type feeding sheet 11 so that a constant distance is maintained between the outer peripheral plane of the feeding sheet 11 and the ink receiving sheet 21. Moreover, the capping sheet conveying mechanism 60 moves the capping sheet 22 along the rotational locus of the endless belt-type feeding sheet 11 so that a constant distance is maintained between the outer peripheral plane of the feeding sheet 11 and the capping sheet 22. As a result, the ink receiving sheet conveying mechanism 50 and the capping sheet conveying mechanism 60 can be overlapped with the feeding sheet conveying mechanism 10, and therefore space can be saved.

In the present embodiment, when the purge operation has been performed, the ink that has run down from the ink receiving sheet 21 and has reached the ink tank 72 via the ink tray 71 does not accumulate in one portion of the ink tank 72, but instead flows across the entire area of the ink tank 72. The waste ink is thus collected more efficiently.

Since the sheet cover 70 is provided in the present embodiment, it is possible to provide a base plate or the like below the sheet cover 70, i.e. in the space below the feeding sheet conveying mechanism 10. More space can thus be saved.

Further, in the present embodiment, the sheet cover 70 is inclined downwards towards the paper discharge side when the feeding sheet conveying mechanism 10 is at the retreated position. As a result, the waste ink flowing down the sheet cover 70 runs down efficiently.

In the present embodiment, the unit moving mechanism 30 is also used to mount the capping sheet 22. Since the unit moving mechanism 30 serves two functions, more space can be saved.

In the present embodiment, the purge and capping operations can be performed efficiently by having the controller 90 perform the purge operation followed immediately by the capping operation.

A preferred representative embodiment of the present invention was described above. However, the present invention is not limited to the example described above, and various design changes can be incorporated without departing from the scope of the claims. For example, in the representative embodiment described above, the feeding sheet conveying mechanism 10 is configured as the endless belt-type feeding sheet 11 wound between the pair of feeding sheet conveying rollers 12 and 13. However, the printing sheet may be conveyed using any other configuration capable of conveying a printing sheet. For instance, the endless type feeding sheet may be replaced with wires wound between a pair of rollers.

In the representative embodiment described above, the swing mechanism 26 is configured so as to cause the feeding sheet conveying mechanism 10 to incline with the swing axis 32 as the center. However, the swing mechanism 26 is not restricted to this type of configuration. For example, the swing mechanism 26 may be configured to cause the feeding sheet conveying mechanism 10 to incline by means of a link mechanism or the like.

Further, in the representative embodiment described above, the ink receiving sheet 21 has a configuration whereby it moves along the periphery of the rotational locus of the endless belt-type feeding sheet 11 so that a constant distance is maintained between the outer peripheral plane of the feeding sheet 11 and the ink receiving sheet 21. However, the ink receiving sheet 21 is not restricted to this configuration. For example, the ink receiving sheet may have a configuration whereby it moves along a locus other than the periphery of the rotational locus of the endless belt-type feeding sheet 11. For example, the ink receiving sheet may have a configuration whereby the ink receiving sheet is wound around a shaft in a position allowing printing and, for the ink receiving position, the ink receiving sheet is pulled out from the shaft so as to be opposite the ink jet faces 4*a*.

In the representative embodiment described above, a configuration provided with the ink tray 71 was presented. However, the ink tray 71 need not be provided. In this case, it is preferred that a small tray is provided at the downwardly inclined edge of the ink receiving sheet 21. The tray is also moved when the ink receiving sheet 21 moves, and the ink within the tray runs down across the entire area of the ink tank 72.

The sheet cover 70 is provided in the representative embodiment described above. However, the sheet cover 70 need not be provided.

In the representative embodiment described above, the capping sheet 22 and the capping sheet conveying mechanism 60 are provided. However, the capping sheet 22 and the capping sheet conveying mechanism 60 need not be provided.

In the present invention, it is preferred that the unit moving mechanism 30 swings the unit 200 and the feeding sheet conveying mechanism 10 with the pivot axis 32 as the center. The rotational axis 32 of the feeding sheet conveying mechanism 10 is thus fixed, and consequently the feeding sheet conveying mechanism 10 can be positioned accurately at the feeding position (the third position) and the retreated position (the fourth position).

In the present embodiment, it is preferred that the ink receiving sheet conveying mechanism 50 moves the ink receiving sheet 21 between the ink receiving position (the second position) and the position allowing recording (the first position) in order to maintain a constant distance between the feeding sheet 11 and the ink receiving sheet 21. Space can be saved because the ink receiving sheet 21 moves along the rotational locus of the feeding sheet 11.

In the present embodiment, it is preferred that the ink receiving sheet conveying mechanism 50 is provided with the set of second rollers 52 and 53 that are coaxial with the first rollers 12 and 13 respectively, and the ink receiving sheet conveying endless belts 54 that are wound across the set of second rollers 52 and 53 and to which the ink receiving sheet 21 is attached. It is also preferred that the diameter of the second rollers is greater than the diameter of the first rollers. The ink receiving sheet 21 thus moves along the rotational locus of the feeding sheet 11, and consequently the ink receiving sheet conveying mechanism 50 can be overlapped with the feeding sheet conveying mechanism 10. More space can thus be saved.

In the present invention, it is preferred that the following are provided: the ink receiving tray that receives the ink running down from the ink receiving sheet, and the ink tank disposed beneath the ink receiving tray. It is preferred that, when the feeding sheet conveying mechanism 10 is at the retreated position (the fourth position), the ink receiving tray is disposed such that an edge thereof is inclined upwards. This inclined edge corresponds to the lower edge of the ink receiving sheet that has been located at the ink receiving position (the second position). Further, it is preferred that the ink receiving tray has a plurality of holes, and that the area of the holes per unit area of the ink tray gradually increases from the higher edge to the lower edge. The ink running down from the ink receiving sheet consequently does not accumulate in only one part of the ink tank 72 and is instead spread across the entire area of the ink tank 72. The ink is thus collected with greater efficiency.

In the present invention, it is preferred that the sheet cover 70 is provided above the ink receiving tray 71 and below the ink receiving sheet that has been located at the position allowing recording (the first position). As a result, ink does not run below the sheet cover 70, and a base plate or the like can be provided in the space below the sheet cover 70. More space is thus saved.

In the present invention, it is preferred that, when the feeding sheet conveying mechanism 10 is in the retreated position, the sheet cover 70 is parallel with the ink receiving sheet 21 that has been located at the position allowing recording. As a result, the ink flowing down the sheet cover 70 can run down efficiently into the ink receiving tray 71.

In the present invention, it is preferred that the following are provided to cover the ink jet faces 4*a*: the capping sheet 22 attached to the ink jet heads 1, and the capping sheet conveying mechanism 60 that locates the capping sheet 22 at the capping position (the position that allows capping) or at the non-capping position. It is preferred that the capping sheet conveying mechanism 60 moves the capping sheet 22 from the non-capping position to the capping position when the feeding sheet conveying mechanism 10 is at the retreated position and, at this state, the unit moving mechanism 30 moves the feeding sheet conveying mechanism 10 from the retreated position to the feeding position, thereby causing the capping sheet 22 to be opposite the ink jet faces 4*a*. The ink jet faces 4*a* of the ink jet heads 1 can thus be prevented from drying out. The unit moving mechanism 30 thus also serves the function of attaching the capping sheet 22 to the ink jet faces 4*a*, and consequently more space can be saved.

In the present invention, it is preferred that the capping sheet conveying mechanism 60 is provided with the set of third rollers 62 and 63 that are coaxial with the set of first rollers 12 and 13 respectively, and with the endless capping sheet conveying belts 64 that are wound across the set of third rollers 62 and 63 and to which the capping sheet 22 is attached. It is preferred that the diameter of the third rollers is greater than the diameter of the first rollers, and is smaller than the diameter of the second rollers. The capping sheet 22 thus moves along the space between the rotational locus of the ink receiving sheet 21 and the rotational locus of the feeding sheet 11. Consequently, the capping sheet conveying mechanism 60 can be overlapped with the ink receiving sheet conveying mechanism 50 and the feeding sheet conveying mechanism 10, and more space can thus be saved.

In the present invention, the controller 90 is provided for controlling the ink jet recording device. It is preferred that when the controller 90 has received the command to stop the ink jet recording device, the controller 90 controls the unit moving mechanism 30, the ink receiving sheet conveying mechanism 50, and the capping sheet conveying mechanism 60 to move the feeding sheet conveying mechanism 10 to the retreated position, to move the ink receiving sheet 21 to the ink receiving position, and to move the capping sheet 22 to the capping position, then controls the ink jet heads 1 to jet ink towards the ink receiving sheet, then controls the ink receiving sheet conveying mechanism 50 to move the ink receiving sheet 21 from the ink receiving position to the position allowing recording, and then controls the unit moving mechanism 30 to move the feeding sheet conveying mechanism 10 from the retreated position to the feeding position. The purge operation and the capping operation are thus performed efficiently.

What is claimed is:

1. An ink jet printer for printing on a printing sheet by jetting ink, comprising:

an ink jet head comprising an ink jet face and a plurality of ink jet nozzles distributed on the ink jet face;

a unit comprising;

a first conveying mechanism that conveys the printing sheet along a feeding plane;

an ink receiving sheet that receives ink jetted from the ink jet head; and a second conveying mechanism that conveys the ink receiving sheet between a first position and a second position;

a unit moving mechanism that moves the unit between a third position and a fourth position; and an ink collecting mechanism that collects ink running down from the ink receiving sheet at the second position;

wherein the ink receiving sheet at the first position is not opposite the ink jet face, and the ink receiving sheet at the second position is opposite the ink jet face, and wherein the feeding plane of the unit at the third position is parallel to the ink jet face, and the feeding plane of the unit at the fourth position is inclined with respect to the ink jet face.

2. An ink jet printer of claim 1, wherein:

the first conveying mechanism comprises a pair of first rollers, the unit further includes a first endless belt wound between the pair of first rollers, and the feeding plane is defined by the first endless belt extending between the pair of first rollers.

3. An ink jet printer of claim 2, wherein;

the ink receiving sheet at the first position is located below the first endless belt, and the ink receiving sheet at the second position is located above the first endless belt.

4. An ink jet printer of claim 2, wherein;

the unit moving mechanism swings the unit around an axis extending parallel to axes of the pair of first rollers.

5. An ink jet printer of claim 2, wherein the second conveying mechanism conveys the ink receiving sheet along an outer side of the first endless belt.

6. An ink jet printer of claim 5, wherein the second conveying mechanism further comprises:

a pair of second rollers, each second roller being coaxial with each respective first roller, and a diameter of each of the second rollers being larger than a diameter of each of the first rollers; and a second endless belt, the ink receiving sheet being fixed to the second endless belt.

7. An ink jet printer of claim 1, wherein the ink collecting mechanism further comprises:

an ink tray that guides ink running down from the ink receiving sheet; and an ink collecting tank located below the ink tray, wherein the ink tray is inclined with respect to the ink receiving sheet in a direction such that one end of the ink tray is higher than the other end of the ink tray, the higher end side of the ink tray being opposite a lower side of the ink receiving sheet, this side of the ink receiving sheet being lower than the other end of the ink receiving sheet while the unit is at the fourth position, and the ink tray is provided with a plurality of holes, the area of holes per unit area of the ink tray being smaller at the higher end side and larger at the lower end side.

8. An ink jet printer of claim 7, wherein the ink collecting mechanism further comprises:

a sheet cover that receives ink running down from the ink receiving sheet, the sheet cover being located below the ink receiving sheet and above the ink tray.

9. An ink jet printer of claim 8, wherein the sheet cover is parallel to the ink receiving sheet at the first position.

10. An ink jet printer of claim 1, the unit further comprising:

a cap; and a third conveying mechanism that conveys the cap between a fifth position and a sixth position, wherein the unit moving mechanism comprises a lift mechanism that moves the cap vertically, and wherein the cap makes contact with the ink jet face and seals the ink jet nozzles from the atmosphere by conveying the cap to the fifth position by the third conveying mechanism while the unit is at the fourth position, moving the unit to the third position by the unit moving mechanism while the cap is at the fifth position, and subsequently lifting the carrier by the lift mechanism.

11. An ink jet printer of claim 10, wherein the third conveying mechanism further comprises:

a pair of third rollers; each third roller being coaxial with each respective first roller, and a diameter of each of the third rollers being larger than a diameter of each of the first rollers; and a third endless belt, the cap being fixed to the third endless belt.

12. An ink jet printer of claim 11, further comprising:

a controller, the controller controlling the ink jet head, the second conveying mechanism, the third conveying mechanism and the unit moving mechanism so as to perform the following operations when a print stopping signal is received by the controller;

(1) conveying the ink receiving sheet by the second conveying mechanism to the second position, conveying the cap by the third conveying mechanism to the fifth position, and moving the unit by the unit moving mechanism to the fourth position, (2) jetting ink from the ink jet nozzles; and (3) conveying the ink receiving sheet by the second conveying mechanism to the first position, and moving the unit by the unit moving mechanism to the third position.

13. An ink jet printer of claim 10, wherein all of the first conveying mechanism, the unit moving mechanism and the lift mechanism are driven by a same source of power.

14. An ink jet printer of claim 10, wherein both the second conveying mechanism and the third conveying mechanism are driven by a same source of power.

15. An ink jet printer of claim 1, further comprising:

a controller, the controller controlling the ink jet head, the second conveying mechanism and the unit moving mechanism so as to perform the following operations when a print stopping signal is received by the controller;

(1) conveying the ink receiving sheet by the second conveying mechanism to the second position, and moving the unit by the unit moving mechanism to the fourth position, (2) jetting ink from the ink jet nozzles; and (3) conveying the ink receiving sheet by the second conveying mechanism to the first position, and moving the unit by the unit moving mechanism to the third position.

16. An ink jet printer of claim 1, wherein both the first conveying mechanism and the unit moving mechanism are driven by a same source of power.

17. An ink jet printer of claim 1, wherein a length of the ink jet face is equal to or longer than that of the printing sheet in a direction orthogonal to a direction of the first conveying mechanism that conveys the printing sheet.

18. An ink jet printer for printing on a printing sheet by jetting ink, comprising:

an ink jet head comprising an ink jet face and a plurality of ink jet nozzles distributed on the ink jet face;

a unit comprising;

a first endless belt that supports the printing sheet;

a first conveying mechanism that conveys the first endless belt along a feeding plane;

an ink receiving sheet that receives ink jetted from the ink jet head;

a second endless belt, the ink receiving sheet being fixed to the second endless belt, and a second conveying mechanism that conveys the second endless belt along an outer side of the first endless belt between a first position and a second position;

a unit moving mechanism that moves the unit between a third position and a fourth position; and an ink collecting mechanism that collects ink running down from the ink receiving sheet at the second position;

wherein the ink receiving sheet at the first position is not opposite the ink jet face, and the ink receiving sheet at the second position is opposite the ink jet face, and wherein the feeding plane of the unit at the third position is parallel to the ink jet face, and the feeding plane of the unit at the fourth position is inclined with respect to the ink jet face.

* * * * *